US007147316B2

(12) United States Patent
Hayashi et al.

(10) Patent No.: US 7,147,316 B2
(45) Date of Patent: Dec. 12, 2006

(54) IMAGE FORMING DEVICE

(75) Inventors: Shigeyuki Hayashi, Gifu-ken (JP); Masatoshi Kokubo, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/336,747

(22) Filed: Jan. 6, 2003

(65) Prior Publication Data

US 2003/0128373 A1 Jul. 10, 2003

(30) Foreign Application Priority Data

Jan. 7, 2002 (JP) ..... 2002-000588
Jan. 11, 2002 (JP) ..... 2002-004732

(51) Int. Cl.
*B41J 2/01* (2006.01)
*B41J 29/38* (2006.01)

(52) U.S. Cl. ..... 347/104; 347/16

(58) Field of Classification Search ..... 347/104, 347/16, 101, 19, 4, 2, 105, 9
See application file for complete search history.

(56) References Cited

U.S. PATENT DOCUMENTS 4,074,279 A * 2/1978 Ikeda et al. ..... 347/14
4,794,384 A 12/1988 Jackson
6,220,686 B1 4/2001 Ludi et al.
6,352,332 B1 * 3/2002 Walker ..... 347/19
6,378,977 B1 * 4/2002 Gompertz ..... 347/19
6,585,341 B1 * 7/2003 Walker et al. ..... 347/14
6,586,759 B1 * 7/2003 Mayo et al. ..... 250/559.4

FOREIGN PATENT DOCUMENTS

JP 56024868 A * 3/1981
JP 01264880 A * 10/1989
JP A 5-307437 11/1993

* cited by examiner

*Primary Examiner*—Stephen Meier
*Assistant Examiner*—Leonard Liang
(74) *Attorney, Agent, or Firm*—Oliff & Berridge, PLC

(57) ABSTRACT

An image forming device that is capable of performing transfer of paper constantly in a highly accurate manner, irrespective of types or conditions of paper. The image forming device is provided with a motion sensor in a paper transfer path thereof for detecting the surface condition of an idle roller moving in accordance with the paper, and transfer of the paper is controlled on the basis of surface condition signals generated by the motion sensor. The motion sensor makes laser light, which is irradiated by a semiconductor laser, hit on an outer peripheral surface of the idle roller that rotates accompanying the transfer of paper and the reflected light is received by a two-dimensional semiconductor image sensor. Then, the surface condition signals are detected on the basis of speckle patterns generated in the reflected light.

48 Claims, 20 Drawing Sheets

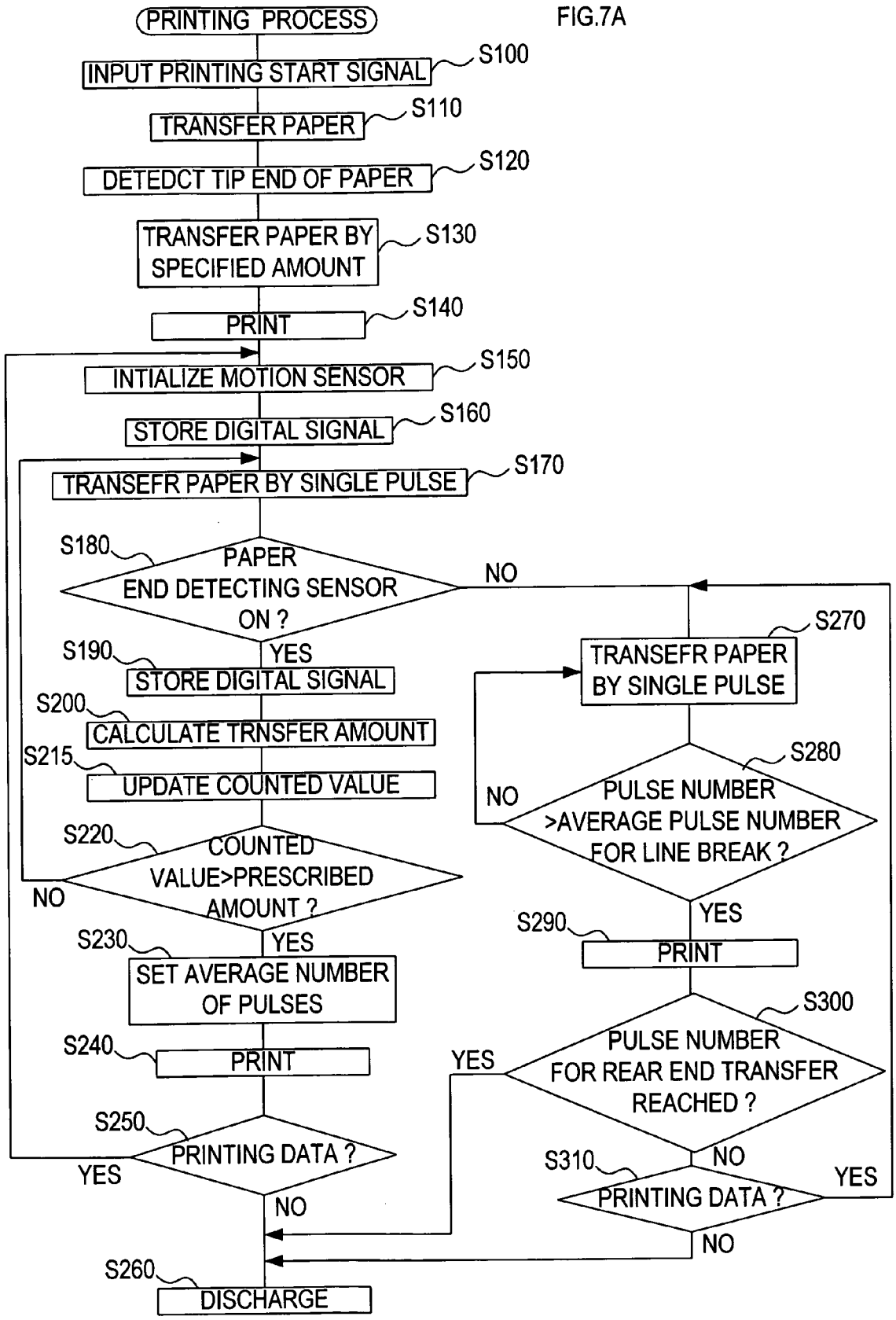
FIG.7A
PRINTING PROCESS
INPUT PRINTING START SIGNAL
S100
TRANSFER PAPER
S110
DETEDCT TIP END OF PAPER
S120
TRANSFER PAPER BY SPECIFIED AMOUNT
S130
PRINT
S140
INTIALIZE MOTION SENSOR
S150
STORE DIGITAL SIGNAL
S160
TRANSEFR PAPER BY SINGLE PULSE
S170
S180
PAPER END DETECTING SENSOR ON ?
NO
YES
S190
STORE DIGITAL SIGNAL
S200
CALCULATE TRNSFER AMOUNT
S215
UPDATE COUNTED VALUE
S220
COUNTED VALUE>PRESCRIBED AMOUNT ?
NO
YES
S230
SET AVERAGE NUMBER OF PULSES
S240
PRINT
S250
PRINTING DATA ?
YES
NO
S260
DISCHARGE
S270
TRANSEFR PAPER BY SINGLE PULSE
S280
PULSE NUMBER >AVERAGE PULSE NUMBER FOR LINE BREAK ?
NO
YES
S290
PRINT
S300
PULSE NUMBER FOR REAR END TRANSFER REACHED ?
YES
NO
S310
PRINTING DATA ?
YES
NO

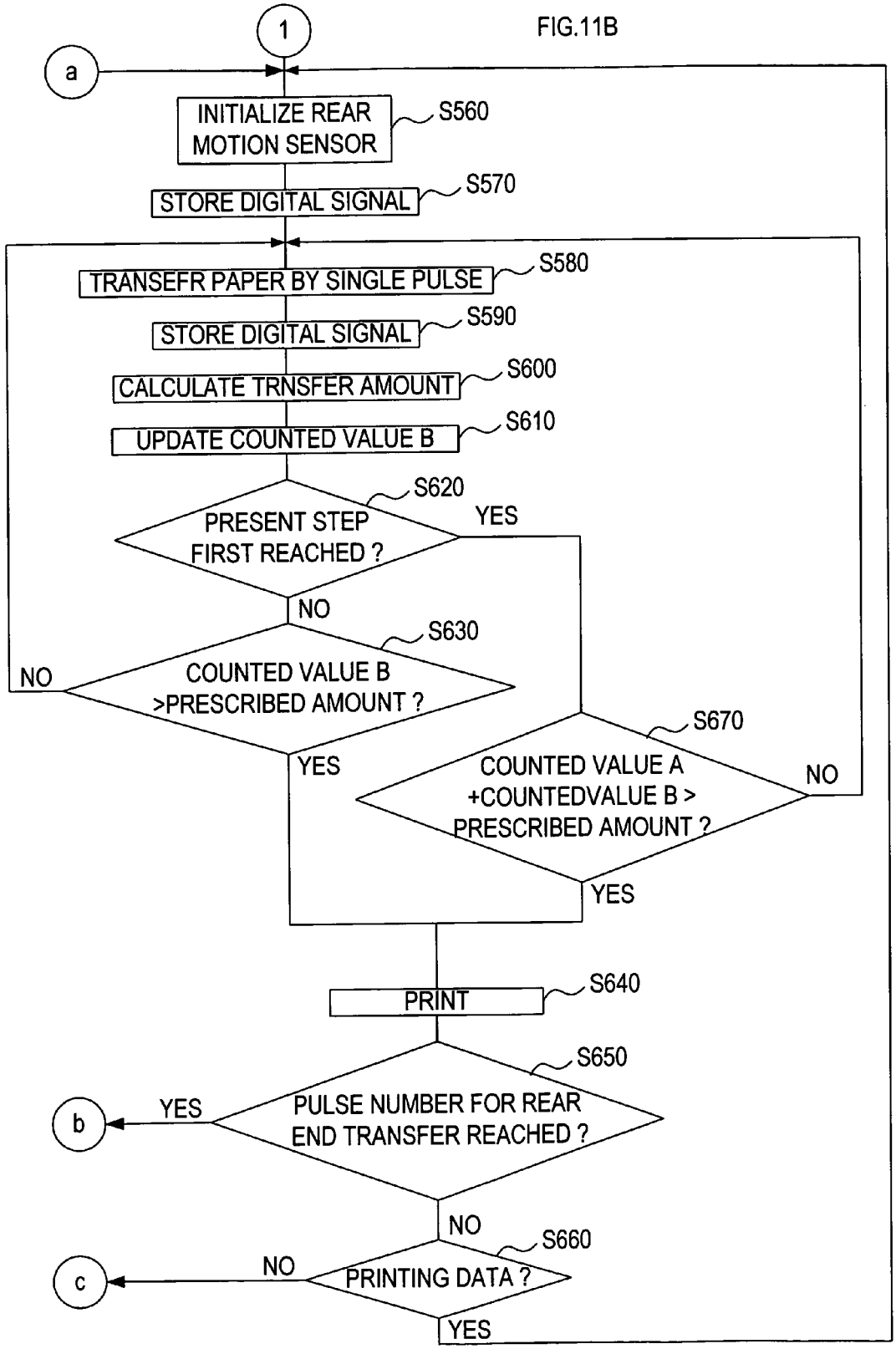
FIG.11B
1
a
INITIALIZE REAR MOTION SENSOR
S560
STORE DIGITAL SIGNAL
S570
TRANSEFR PAPER BY SINGLE PULSE
S580
STORE DIGITAL SIGNAL
S590
CALCULATE TRNSFER AMOUNT
S600
UPDATE COUNTED VALUE B
S610
PRESENT STEP FIRST REACHED ?
S620
YES
NO
COUNTED VALUE B >PRESCRIBED AMOUNT ?
S630
NO
YES
COUNTED VALUE A +COUNTEDVALUE B > PRESCRIBED AMOUNT ?
S670
NO
YES
PRINT
S640
PULSE NUMBER FOR REAR END TRANSFER REACHED ?
S650
YES
b
NO
PRINTING DATA ?
S660
NO
c
YES

IMAGE FORMING DEVICE

BACKGROUND OF THE INVENTION

1. Field of the Invention

The present invention relates to an image forming device capable of performing transfer of paper in a highly accurate manner.

2. Description of the Prior Art

An image forming device such as a printer was conventionally provided with a stepping motor or a DC motor provided with an encoder as a driving source, and a paper transfer mechanism for transmitting rotation of the stepping motor or the DC motor to transfer rollers through gear trains and thereby transferring paper through the transfer rollers.

When a stepping motor is used as a driving source, the amount of transferring paper is controlled by controlling the amount of rotation of the motor using pulse driving. When a DC motor provided with an encoder is used as a driving source, the amount of transferring paper is controlled by controlling the amount of rotation of the DC motor using closed-loop control based on the output of the encoder.

However, the amount of transferring paper that is actually transferred, which cannot be detected by a stepping motor itself, can only be estimated based on the number of driving pulses supplied to the motor. On the other hand, the transfer accuracy of a DC motor provided with an encoder is influenced by the resolution performance of the encoder.

Therefore, improvement in detection accuracy has been desired so as to satisfy the demand these days to detect the amount of transferring paper in high accuracy, for example down to several μm.

Furthermore, it is impossible to perform highly accurate transfer of paper with the above-mentioned control mechanisms, in which the behavior of the paper is estimated based on the operation of the driving system, because of rotational pitch errors due to structures of the motor, accuracy errors of gears caused during manufacture thereof, outer diameter errors of transfer rollers and errors in transfer amounts that are dependent on the types of paper used.

The present invention has been made in view of the above points, and it is an object thereof to provide an image forming device capable of detecting the movement of a medium to be printed on in high accuracy and performing accurate transfer of the medium to be printed on.

SUMMARY OF THE INVENTION

The above and other objects are achieved by an image forming device for transferring a medium to be printed on in order to perform image formation. The image forming device comprises transfer means for transferring the medium to be printed on; drive means for driving the transfer means; an observation object to be moved directly or indirectly by the transfer means; surface condition signal generating means for irradiating the observation object with light having coherency, receiving the reflected light reflected by the surface of the observation object and generating signals with respect to the surface condition of the observation object in accordance with the received reflected light; and moving amount detecting means for calculating the moving amount of the observation object by chronologically comparing the surface condition signals generated by the surface condition signal generating means. Control means is provided for controlling the drive means based on detection results of the moving amount of the observation object, which moves when the transfer means is driven by the drive means, obtained by the moving amount detecting means.

In the image forming device of the present invention, light is irradiated onto the observation object and the moving amount of the observation object is detected accurately based on the detection results of the reflected light from the surface, then the transfer of the medium to be printed on is controlled based on the accurately detected moving amount, with the result that accurate transfer of the medium to be printed on can be performed.

In another aspect of the invention, there is provided an image forming device for transferring paper in order to perform image formation. The image forming device comprises transfer means for transferring paper; drive means for driving the transfer means; surface condition signal generating means for irradiating the paper with light having coherency, receiving the reflected light reflected by the surface of the paper and generating signals with respect to the surface condition of the paper in accordance with the received reflected light; moving amount detecting means for calculating the moving amount of the paper by chronologically comparing the surface condition signals generated by the surface condition signal generating means; and control means for controlling the drive means based on detection results of the moving amount of the paper, which moves when the transfer means is driven by the drive means, obtained by the moving amount detecting means.

In the image forming device of the present invention, light having coherency is irradiated onto the paper and surface condition signals are generated based on the reflected light.

In this case, the position on the surface of the paper by which the light is reflected is shifted in accordance with the transfer of the paper, so that the state of the reflected light is changed.

In other words, changes in the state of the reflected light correspond to the transfer of the paper, and changes in the surface condition signals generated base on the reflected light accordingly correspond to the transfer of the paper.

Therefore, the image forming device of the present invention is capable of detecting the transfer amount of the paper based on the changes in the surface condition signals and, for example, controlling the transfer of the paper by using the detected transfer amount.

BRIEF DESCRIPTION OF THE DRAWINGS

Preferred embodiments according to the present invention will now be described with reference to the drawings in which:

FIG. 7A is a flowchart illustrating the printing processes performed by the ink jet printer 1 of Embodiment 1;

FIGS. 11A and 11B are flowcharts illustrating the printing processes performed by the ink jet printer of Embodiment 2;

DETAILED DESCRIPTION OF PREFERRED EMBODIMENTS

Figure 1:
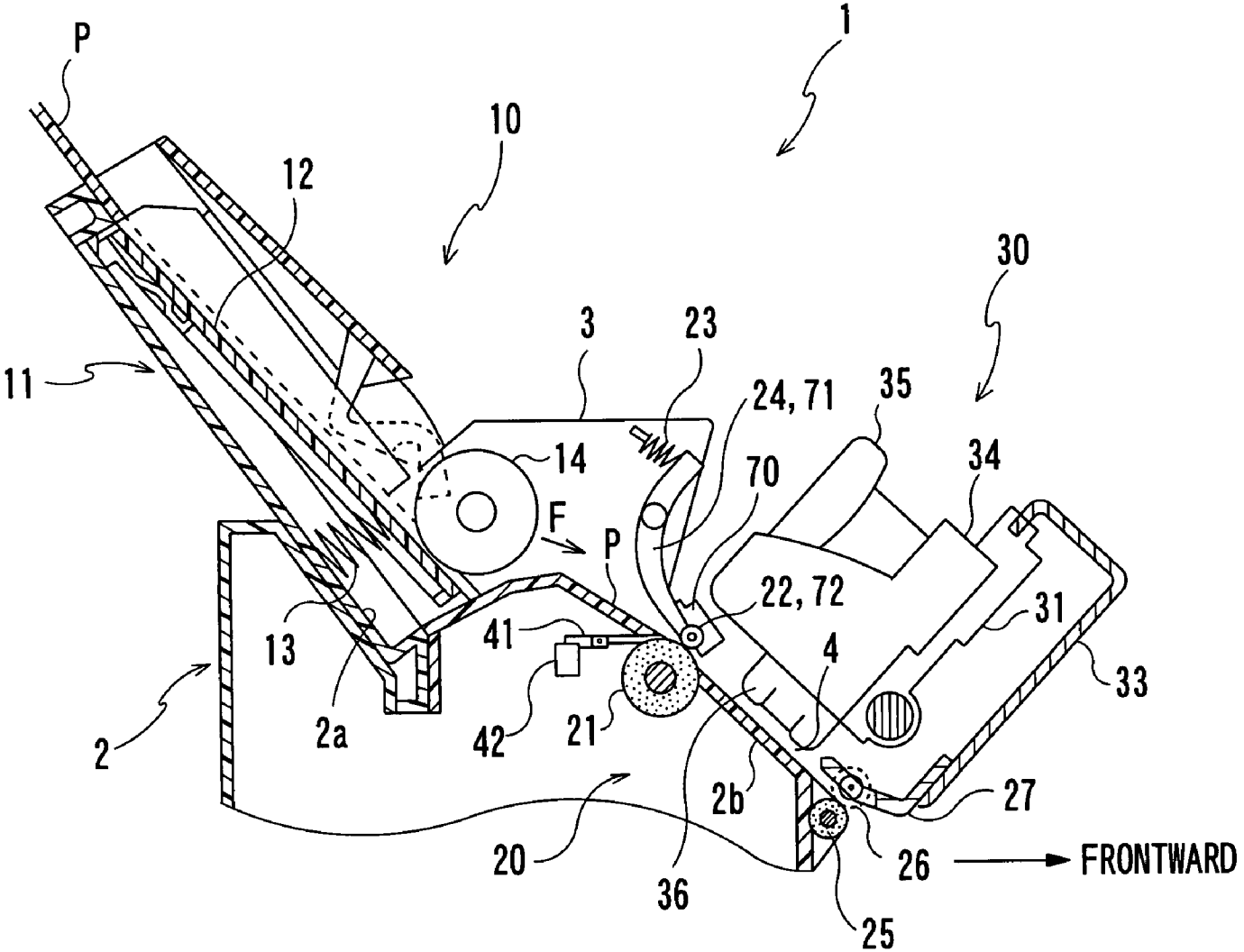
FIG. 1 is a sectional view illustrating the overall structure of an ink jet printer of Embodiment 1.

An image forming device of the present invention will now be explained hereinafter with reference to an ink jet printer.

(Embodiment 1)

The overall structure of an ink jet printer 1 will now be explained with reference to FIG. 1.

The ink jet printer 1 comprises a paper feed mechanism 10 capable of accommodating a plurality of sheets of paper P and of supplying the plurality of sheets of paper one by one, a paper transfer mechanism 20 for transferring the paper P that has been supplied by the paper feed mechanism 10 through a paper transfer path 4 to a paper eject table (not shown), a print mechanism 30 for jetting ink onto the paper P during transfer for printing (image forming), a drive mechanism (not shown) for transmitting driving force to rollers included in the paper feed mechanism 10 and the paper transfer mechanism 20, a controller 50 (not illustrated in FIG. 1) for controlling actions of each of the above-listed portions, a motion sensor 70 (surface condition signal generating means) for detecting the surface condition of a roller and thereby obtaining positional information of paper P and outputting such information to the controller 50, and a main body frame 2 for supporting each of the above-listed portions.

The structure of the paper feed mechanism 10 will now be explained with reference to FIG. 1.

The paper feed mechanism 10 is comprised with a paper feed cassette 11 that is attached in a freely attachable/detachable manner to a cassette mounting concave 2*a* formed at an upper end of a rear end portion of the main body frame 2.

The paper feed cassette 11 is comprised, on an upper side thereof (upside in FIG. 1.), with a paper table 12 onto which a plurality of sheets of paper P is stacked. A rear end portion (left-hand side in FIG. 1) of the paper table 12 is pivotally supported at a main body of the paper feed cassette 11 in a freely swinging manner while a front end portion (right-hand side in FIG. 1) thereof is biased upwardly by a compression coil spring 13.

Further, the paper feed mechanism 10 is comprised with a laterally extending (in the depth direction in FIG. 1) paper feed roller 14 on an upper side of the front end portion of the paper table 12. Both lateral ends of the paper feed roller 14 are pivotally supported, each in a freely rotating manner, by a pair of right and left side wall plates 3 coupled to the main body frame 2, and the paper feed roller 14 is rotated by the rotating force that is transmitted from a feed motor 62 (not shown) via the drive mechanism (not shown).

The plurality of sheets of paper P that are stacked on the paper table 12 of the paper feed cassette 11 is pressed against the paper feed roller 14 by the compression coil spring 13 through the paper table 12. Accordingly, when the paper feed roller 14 is rotated by the drive mechanism in a counter-clockwise direction, the uppermost sheet of paper P that contacts the paper feed roller 14 is fed in a paper feeding direction F that is directed to the print mechanism 80 (right-hand side direction in FIG. 1).

The structure of the paper transfer mechanism 20 will now be explained with reference to FIGS. 1 to 3.

The paper transfer mechanism 20 is comprised with a paper transfer path 4 for transferring paper P. The paper transfer path 4 comprises a part of the main body frame 2 that extends from the cassette mounting concave 2*a* to a frontward extending paper guide portion 2*b*.

The paper transfer mechanism 20 is further comprised with a rubber-made first transfer roller 21 pivotally supported in a rotating manner in the paper transfer path 4 upstream (left-hand side in FIG. 1) of a printing head 36 of the print mechanism 30 that will be described later. The first transfer roller 21 is driven in a clockwise direction (clockwise direction in FIG. 1) by the driving force transmitted from the drive-mechanism. A follower roller 22 abuts the first transfer roller 21 from above. The follower roller 22 is pivotally attached to a lower end portion of a swinging arm 24 in a freely rotating manner. While pivotally attached to the side wall plate 3 at its upper end portion, the swinging arm 24 is pressed and biased in a direction of pressing the follower roller 22 against the first transfer roller 21 by means of a compression coil spring 28.

The paper transfer mechanism 20 is further comprised with a rubber-made second transfer roller 25 pivotally supported by the main body frame 2 in a rotating manner in the paper transfer path 4 downstream of the printing head 36. The second transfer roller 25 is driven in the clockwise direction (clockwise direction in FIG. 1) by the driving force transmitted from the drive mechanism. A plurality of spur rollers 26 abut the second feed roller 25 from above. The spur rollers 26, each of which is a gear-like roller with a plurality of radial protrusions, are pivotally supported in a freely rotating manner by a mounting plate 27 that is fixedly attached to a supporting plate 33 (to be described later) at specified intervals in the printing width direction (depth direction in FIG. 1).

With the above-described arrangement, paper P that has been fed from the paper feed mechanism 10 is transferred in the paper transfer direction F in accordance with the rotation of the first transfer roller 21 and the second transfer roller 25.

The paper transfer mechanism 20 is further comprised with a paper end detecting sensor 42 for detecting presence or absence of paper P somewhat upstream of the printing head 36.

Figure 2:
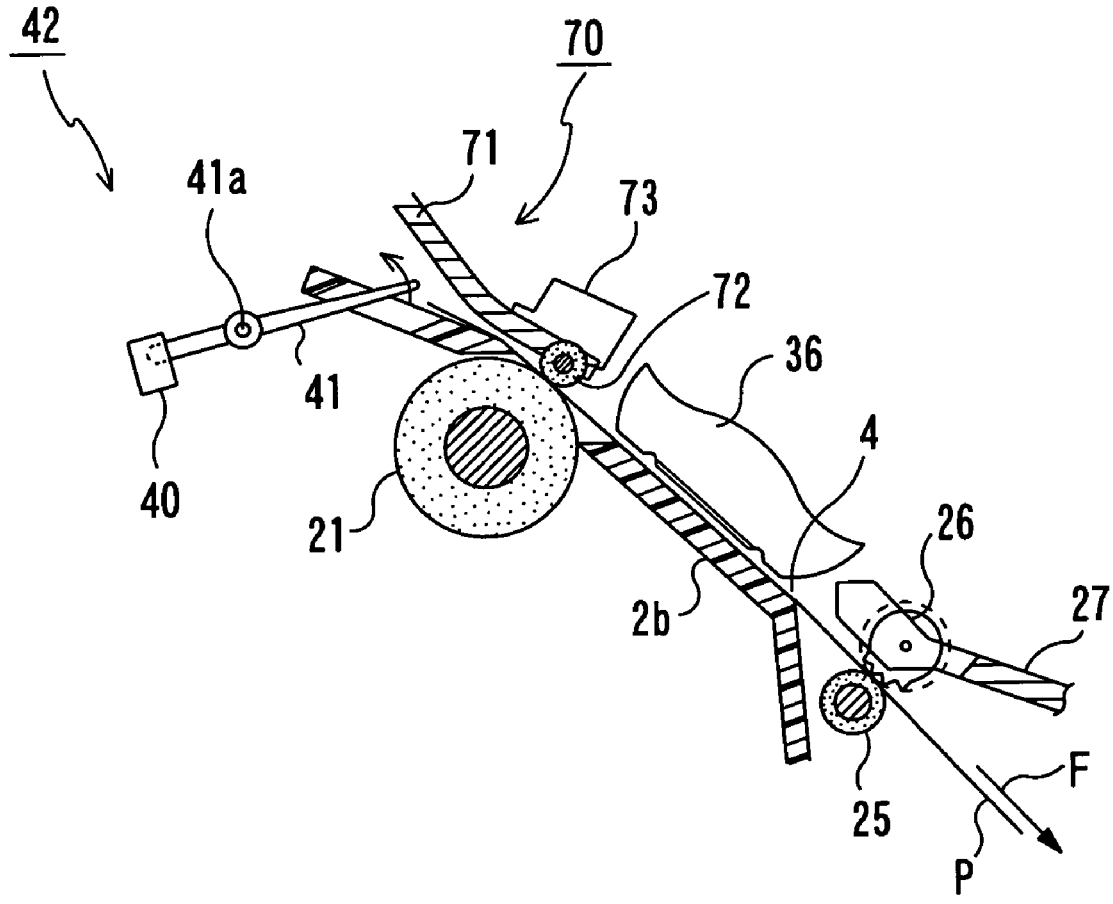
FIG. 2 is a sectional view illustrating the peripheral portion of a paper transfer mechanism of the ink jet printer of Embodiment 1.

As illustrated in FIG. 2, the paper end detecting sensor 42 is provided so as to rotate about axis 41*a*, and is comprised of a rotating portion 41 that is biased in a counter-clockwise direction and a detecting portion 40 that is switched OFF when the rotating portion 41 has rotated in a counter-clockwise direction while it is switched ON when the rotating portion 41 has rotated in a clockwise direction.

Actions of the paper end detecting sensor 42 at the time when paper P passes will be explained hereinafter.

When no paper P is proximate of the printing head 36, the rotating portion 41 is in a condition of having rotated in a counter-clockwise direction by the biasing force with its tip end (right end in FIG. 2) projecting upward of the paper transfer path 4. At this time, the detecting portion 40 is in the switched-OFF condition.

When the paper P is transferred from upstream and its tip end makes the rotating portion 41 rotate in a clockwise direction, the detecting portion 40 is switched ON.

When the paper P further proceeds so that its rear end passes the rotating portion 41, the rotating portion 41 will again start rotating in the counter-clockwise direction by the biasing force and the detecting portion 40 is switched OFF.

In other words, the paper end detecting sensor 42 is switched ON in the presence of paper P while it is switched OFF in the absence of paper P so that presence or absence of paper P may be detected.

The structure of the print mechanism 30 will now be explained with reference to FIGS. 1 and 2.

The print mechanism 30 is comprised with a guide rod 32 supported by side walls (not illustrated) and extending in the lateral directions (depth direction in FIG. 1), a supporting plate 33 provided frontward of the main body frame 2 (right-hand side in FIG. 1) to project upward, and a carriage 31 supported by the guide rod 32 and an upper end portion of the supporting plate 83 to be movable in the lateral directions.

A cartridge holder 34 is fixed to the carriage 31, and an ink cartridge 35 containing therein ink to be supplied for printing is attached to the cartridge holder 34 in a freely attachable/detachable manner.

The printing head 36 is mounted to the carriage 31 so as to face the paper transfer path 4. A plurality of ink jet nozzles (not shown) for jetting ink supplied from the ink cartridge 35 are formed in the printing head 36. The ink jet nozzles are arranged such that, for instance, 64 nozzles are arranged in a double row, i.e. 32 nozzles in each row.

The carriage 31 may perform reciprocating movements in lateral directions by the driving force transmitted from a carriage drive mechanism (not shown). When printing, selective jet-driving of, for instance, the 64 ink jet nozzles is performed on the basis of dot pattern data to be printed while making the carriage 31 (ink jet nozzles) perform reciprocating movements.

Figure 3:
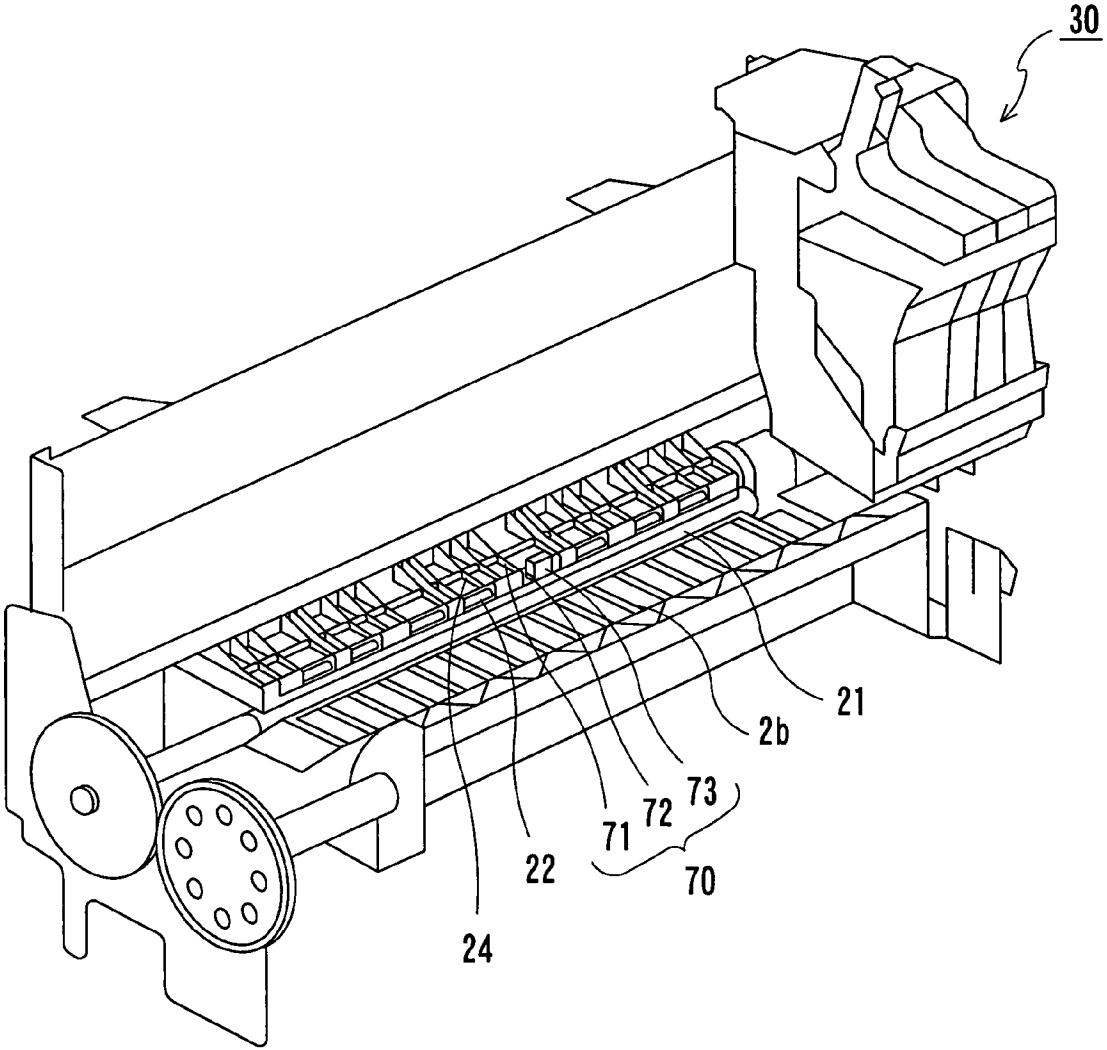
FIG. 3 is a perspective view illustrating the peripheral portion of a motion sensor of the ink jet printer of Embodiment 1.

It should be noted that the print mechanism 30illustrated in FIG. 3 is different from the print mechanism 30 as illustrated in FIG. 1 in that its structure for supporting the carriage and its structure for mounting the ink cartridge is reversed back to front.

The structure of the controller 50 (control portion) will now be explained with reference to FIG. 4.

Figure 4:
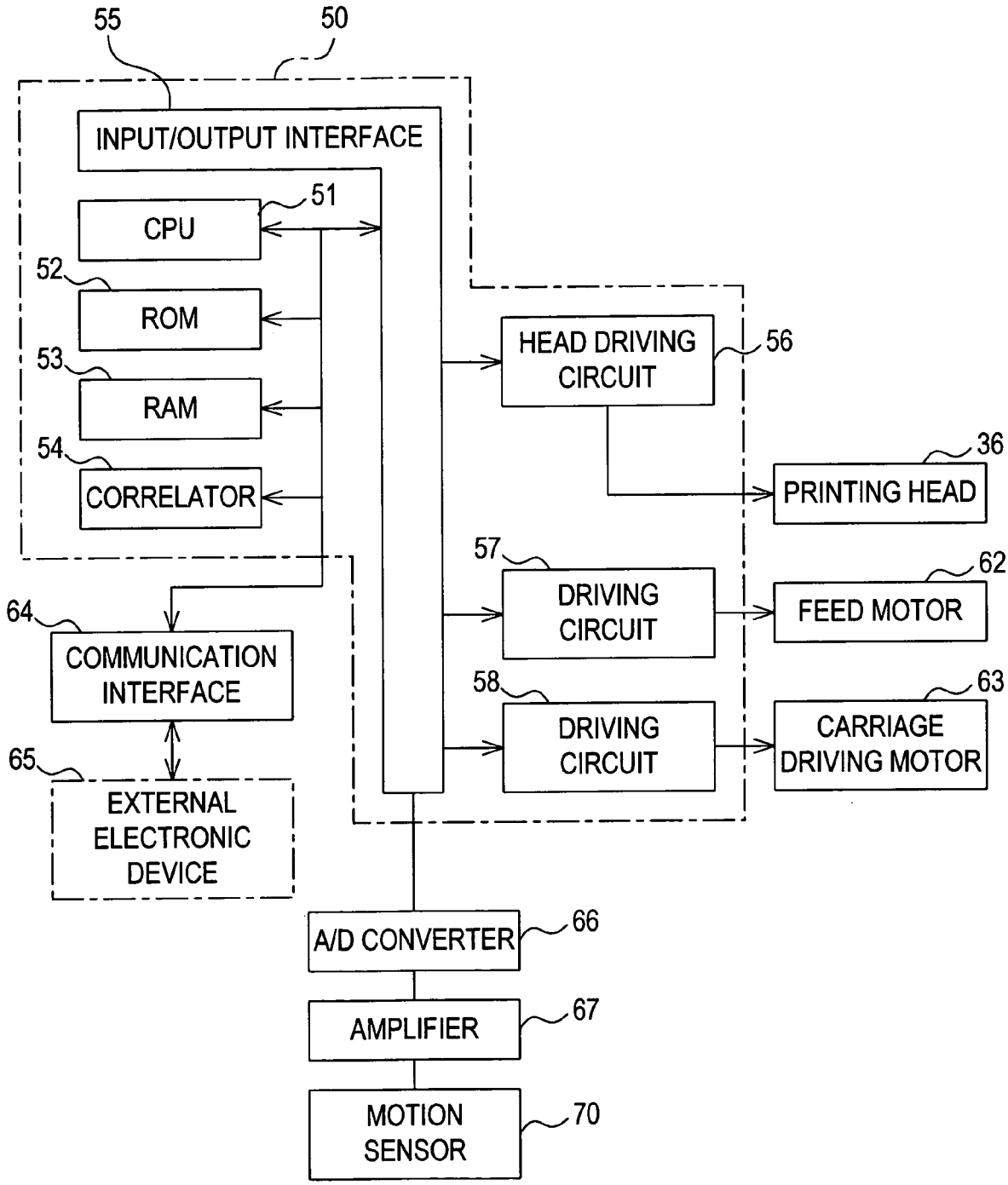
FIG. 4 is a block diagram illustrating the structure of a controller of the ink jet printer of Embodiment 1.

As illustrated in FIG. 4, the controller 50 is comprised with a CPU 51, a ROM 52, a RAM 53, a correlator 54, a head driving circuit 56, a transfer driving circuit 57, a carriage driving circuit 58, and an input/output interface 55 for connection between these components.

The head driving circuit 56 is connected to the printing head 36 and transmits signals related to jet-driving of ink.

The transfer driving Circuit 57 is connected to a feed motor 62 and transmits signals related to driving of the feed motor 62. It should be noted that the feed motor 62 is a stepping motor and is driven at a specified speed in units of a specified pulse time. The feed motor 62 drives the paper feed roller 14 of the paper feed mechanism 10 as well as the first transfer roller 21 and the second transfer roller 25 of the paper transfer mechanism 20.

The carriage driving circuit 58 is connected to a carriage driving motor 63 and transmits signals related to driving of the carriage 31.

The input/output interface 55 interconnects the above-described respective components while it is connected to the motion sensor 70 through an A/D converter 66 and an amplifier 67, and it is also connected to the paper end detecting sensor 42. It is further connected to an external electronic device 65 through an interface for communication 64.

The controller 50 detects movements of paper P on the basis of signals transmitted from the motion sensor 70 (surface condition signals) or signals transmitted from the paper end detecting sensor 42, and controls the feed motor 62, the carriage driving motor 63 and the printing head 36 based on the obtained results. A detailed explanation of the methods will be provided later.

While the controller 50 is capable of performing similar control as controllers within ordinary ink jet printers do, explanations thereof will be omitted here because the present invention does not relate to such control.

The structure of the motion sensor 70 will next be explained with reference to FIGS. 1, 2, 3, 5 and 6.

A mounting position for the motion sensor 70 is upstream of the print mechanism 30 when seen in the transferring direction of paper P as illustrated in FIG. 1 while it is located central in the width direction as illustrated in FIG. 3.

Figure 5:
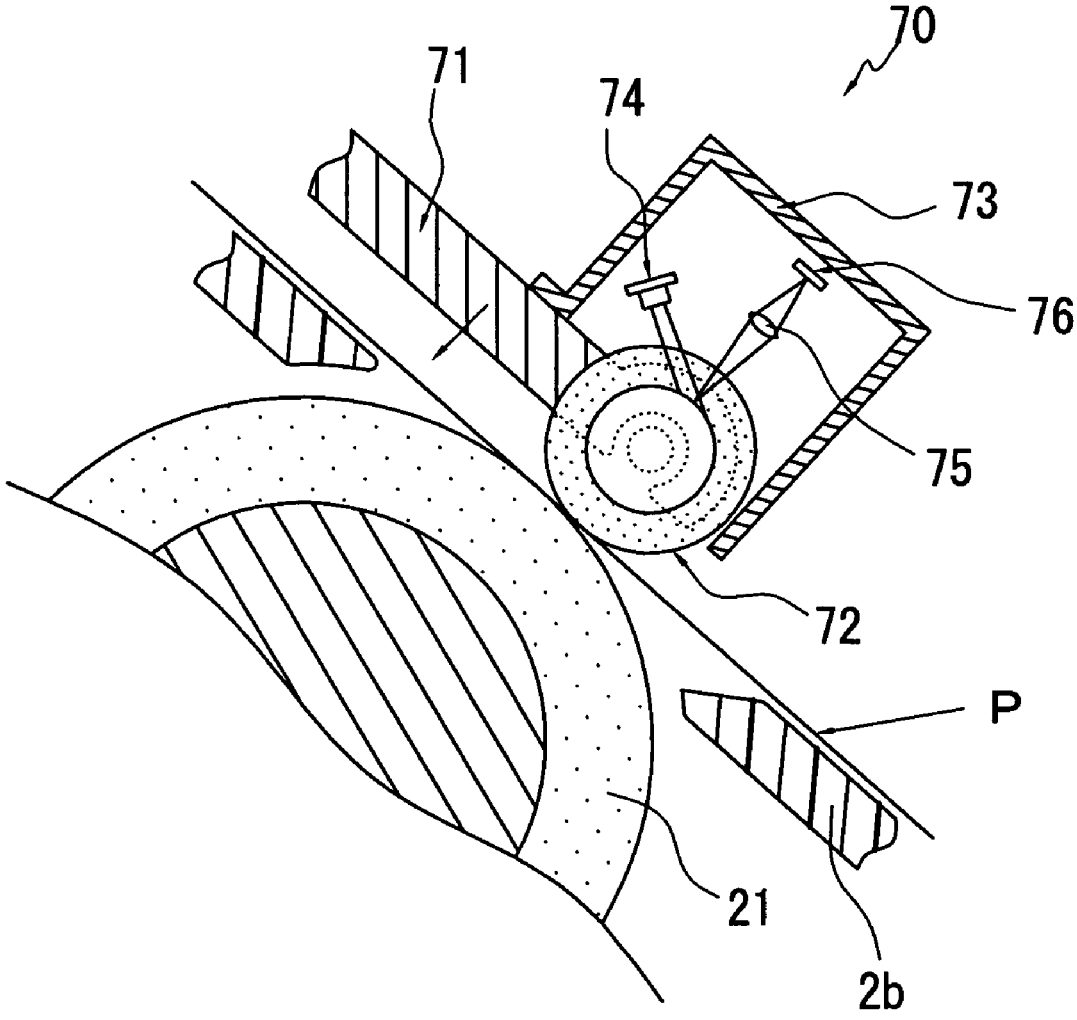
FIG. 5 is a sectional view illustrating the structure of the motion sensor of the ink jet printer of Embodiment 1.

As illustrated in FIG. 5, the motion sensor 70 is comprised with a sensor holder 71, an idle roller 72 (moving member, rotating member) mounted to a lower end of the sensor holder 71 (lower right end in FIG. 5) in a freely rotating manner, and a sensor housing 73 provided on the upper surface of the sensor holder 71, wherein a semiconductor laser 74 for irradiating laser light towards the idle roller 72, a lens 75 for focusing reflected light of the laser light, and a two-dimensional semiconductor image sensor 76 for receiving the reflected light are provided inside of the sensor housing 78.

As illustrated in FIG. 3, the sensor holder 71 is mounted to be parallel to the follower arm 24. In other words, the sensor holder 71 is pivotally attached to the side wall plate 3 in a freely rotating manner about a common axis with the follower arm 24, and is pressed and biased in the direction identical to the pressing and biasing direction of the follower arm 24 (that is, the direction of pressing the idle roller 72 against the first transfer roller 21) by means of a compression coil spring.

As illustrated in FIG. 3, the idle roller 72 is mounted to the lower end of the sensor holder 71 to be coaxial with the follower roller 22. As illustrated in FIG. 2, the idle roller 72 is pressed against paper P in the presence of paper P on the first transfer roller 21 and is rotated accompanying the transfer of the paper P.

Figure 6:
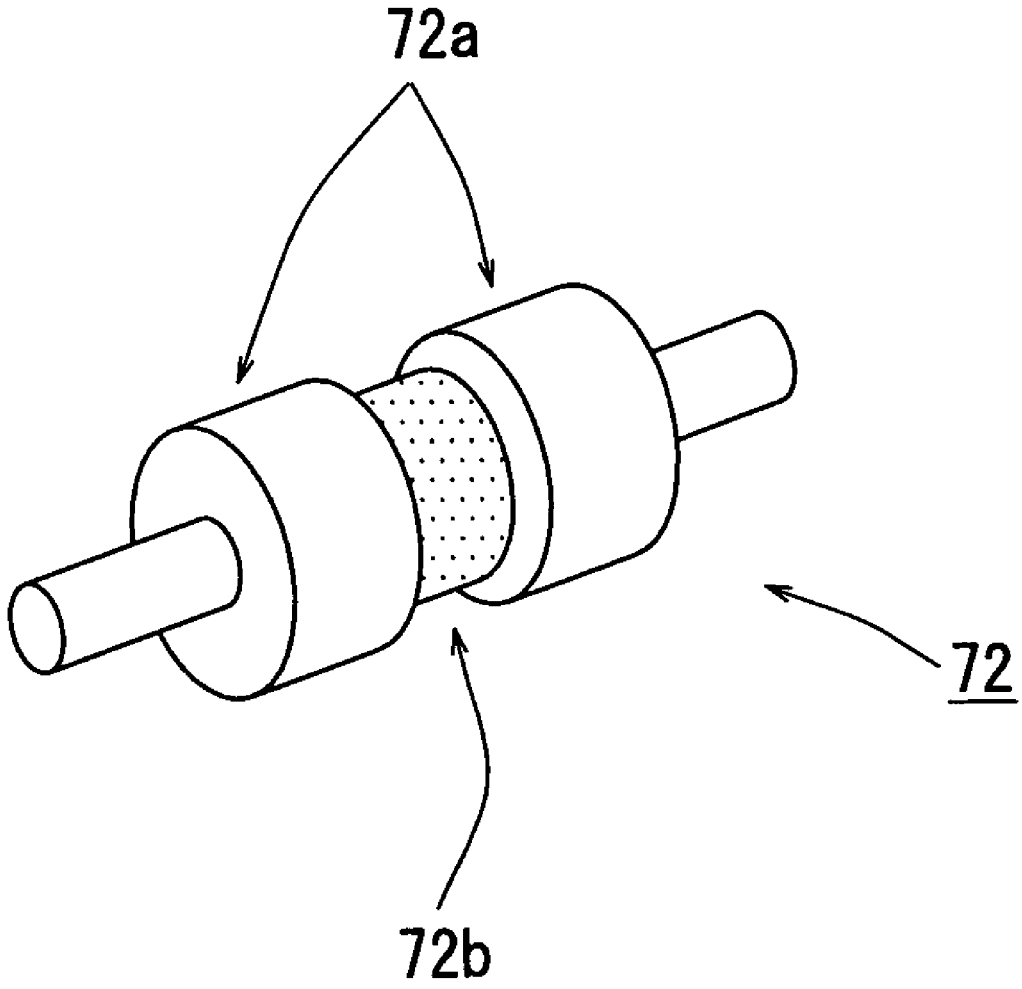
FIG. 6 is a perspective view illustrating a part of the motion sensor of the ink jet printer of Embodiment 1.

Further, the central portion of the idle roller 72 is shaped to be concave with respect to the both sides thereof as illustrated in FIG. 6. In other words, both ends of the idle roller 72 include first outer diameter portions 72*a* having a large diameter (first diameter) while the central portion includes a second outer diameter portion 72*b* having a second outer diameter that is smaller than the first outer diameter.

Accordingly, it is only the outer peripheral surfaces of the first outer diameter portions 72*a* within the entire idle roller 72 that contact the paper P or the first transfer roller 21. It should be noted that the surface of the second outer diameter portion 72*b* of the idle roller 72 should desirably have a suitable roughness and be white so as to obtain contrasts of speckle patterns.

The semiconductor laser 74 irradiates laser light onto the second outer diameter portion 72*b* of the idle roller 72 wherein reflected light is introduced to the two-dimensional semiconductor image sensor 76 upon passing the lens 75. It should be noted that spot-like interference patterns referred to as speckles are generated in the reflected light that are illustrative of the surface shape of the second outer diameter portion 72*b*.

The two-dimensional semiconductor image sensor 76 is comprised with a light-receiving portion in which pixels of approximately 5 μn are arranged in orders of 400 by 400, and performs photoelectric conversion of reflected light from the idle roller 72 for generating image signals. The image signals are sent to the A/D converter 66 upon passing the amplifier 67 and are converted into digital signals.

It should be noted that while such digital signals are utilized for controlling paper transfer, details thereof will be described later.

The printing processes of the ink jet printer 1 will now be explained with reference to FIG. 7A.

In Step 100, a printing start signal and printing data are input from the external electronic device 65 through the interface for communication 64 into the controller 50. Printing data are stored in the RAM 53.

In Step 110, paper P is taken out from the paper feed cassette 11 and is transferred along the transfer path 4.

More particularly, the transfer driving circuit 57 of the data controller 50 (FIG. 4) generates a driving signal and send it to the feed motor 62. The driving force of the feed motor 62 is transmitted to the paper feed roller 14 of the paper feed mechanism 10 through the driving mechanism. The driven paper feed roller 14 takes out the paper P one by one from the paper feed cassette 11 and feeds the sheet to the transfer path 4.

When a tip end of the paper P is detected by the paper end detecting sensor 42 in Step 120, the paper feed roller 14 further rotates by a specified amount in Step 180 so that the tip end of the paper P hits against a nip of the first transfer roller 21 and the follower roller 22 to cause so-called resist actions; thereafter, upon rotational driving of the feed motor 62 in a reverse direction, the first transfer roller 21, which has so far been rotating in a counter-clockwise direction in FIGS. 1 and 2 starts to rotate in a clockwise direction by a specified amount (prescribed amount for tip end) to transfer the paper P until a top of a printing region of the paper P is placed right under the printing head 36 of the print mechanism 30. Thereafter, the first transfer roller 21 and the paper P temporarily stop.

It should be noted that since no driving force of the feed motor 62 is transmitted to the paper feed roller 14 when the first transfer roller 21 is rotationally driven in a clockwise direction by the feed motor 62, no hindrance will be caused ill the transfer of paper P accompanying the rotation of the first transfer roller 21.

In Step 140, printing of the printing data corresponding to the first line is performed by using the print mechanism 30 with the paper P in a suspended condition. In other words, printing is performed by driving the carriage 81 by the driving circuit 58 on the basis of the printing data stored in the RAM 63, and by driving the printing head 36 by the head driving circuit 66.

In Step 150, the counted value stored in the RAM 53 is reset as a preparation for executing a process to be discussed later (i.e. a process of determining whether the counted value since the Step 150 has reached a prescribed amount for line break). The counted value, which is a parameter that is counted up on the basis of signals output from the motion sensor 70, will be described in detail later.

In Step 160, a digital signal (surface condition signal) related to the surface condition of the idle roller 72 and, accordingly, to the position of paper P is detected by using the motion sensor 70 and is stored in the RAM 53.

More particularly, a laser light from the semiconductor laser 74 of the motion sensor 70 is irradiated onto the second outer diameter portion 72*b* of the idle roller 72 and the reflected light thereof is detected by the two-dimensional semiconductor image sensor 76. The two-dimensional semiconductor image sensor 76 performs photoelectric conversion of the reflected light for generating an image signal. The image signal is amplified in the amplifier 67, further converted into a digital signal in the A/D converting circuit 66 and is stored in the RAM 53.

It should be noted that since the laser light has coherency, the reflected light that is received by the two-dimensional semiconductor image sensor 76 includes speckle patterns illustrative of the surface shape of the idle roller 72 at the point the laser light has been reflected, and the digital signal that is obtained by performing photoelectric conversion of the reflected light also includes speckle patterns.

In Step 170, the paper P is transferred in the downstream direction by driving the feed motor 62 by a single pulse. It should be noted that the idle roller 72 is also rotated by a specified amount accompanying the transfer of the paper P.

In Step 180, it is determined whether the paper end detecting sensor 42 is ON or not (that is, whether the rear end in the transferring direction of the paper P has not yet passed the paper end detecting sensor 42 or already has), and the program proceeds to Step 190 when YES. On the other hand, when NO, the program proceeds to Step 270.

In Step 190, a digital signal (surface condition signal) related to the surface condition of the idle roller 72 and, accordingly, to the position of the paper P is stored in the RAM 53, similarly to the above Step 160.

In Step 200, the newest signal and the next newest signal among the digital signals that have been stored in the RAM 58 either in Step 160 or in Step 190 are used for performing calculation in the correlator 64 and the transfer amount by which the paper P has been transferred in the transferring direction in Step 170 is calculated.

Detailed explanations will now be made with reference to FIG. 8.

The digital signal that has been stored in the RAM 53 in Step 160 or Step 190 respectively includes speckle patterns illustrative of the surface shapes at the point laser light has been reflected (surface of the idle roller 72).

When the paper P is transferred, the idle roller 72 rotates by a specified amount so that the point at which laser light is reflected will be shifted, and speckle patterns in the digital signals will be moved by an amount corresponding to the transfer amount of the paper P.

In other words, the speckle patterns prior to transfer of the paper P will be moved to the speckle patterns after transfer of the paper P by an amount corresponding to the transfer amount of the paper P.

Accordingly, the transfer amount of the paper P can be calculated on the basis of measured results obtained by measuring the moving amount of the speckle patterns accompanying the transfer of the paper P. Since the second outer diameter portion 72*b* of the idle roller 72 has a smaller diameter than that of the first outer diameter portion 72*a* contacting the paper P, it should be considered as a matter of fact that the moving amount of speckle patterns in the second outer diameter portion 72*b* will accordingly be smaller.

Figure 8:
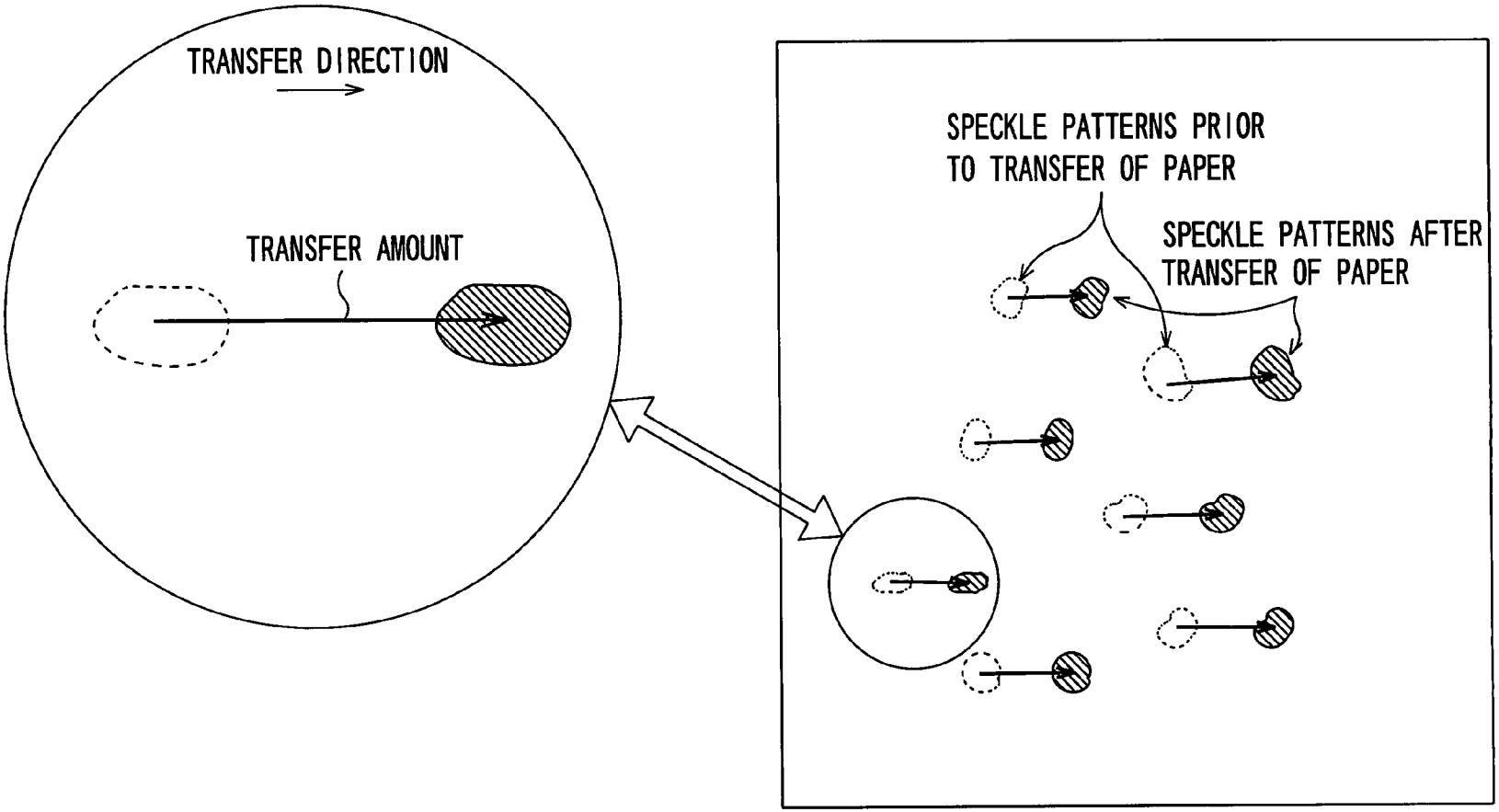
FIG. 8 is an explanatory view illustrating a method for detecting the transfer amount of paper during the printing processes performed by the ink jet printer of Embodiment 1.

Thus, in this Step 200, speckle patterns of the respective digital signals stored in the RAM 53 prior to and after the transfer of the paper P (Step 170) are first compared in the correlator 54 as illustrated in FIG. 8 for determining the moving amount of the speckle patterns. Then, the transfer amount of the paper P in Step 170 is calculated in the CPU 51 on the basis of the results of the determination. The transfer amount of the paper P is stored in the RAM 53.

In Step 215, the transfer amount of the paper P as calculated in Step 200 is added to the counted value, which is a parameter stored in the RAM 53 (an accumulated value of the transfer amount of paper P at the time the Step 215 was executed the last time), for updating the counted value. It should be noted the counted value is a value that is reset in Step 150 as already discussed.

In Step 220, it is determined whether the counted value that has been updated in Step 215 has reached a prescribed amount for line break (a length of the nozzle portions of the printing head 36: for instance, 1 inch). If the prescribed amount for line break has been reached, the program proceeds to Step 230, while if the prescribed amount for line break has not been reached yet, the program proceeds to Step 170.

In Step 230, the number of times driving by a single pulse (Step 170) has been performed after the immediately preceding printing (Step 140 or Step 240) is stored in the RAM 53 as a number of pulses for line break.

Further, the average value of all numbers of pulses for line break counted since printing processes have been started is calculated as the average number of pulses for line break and is stored in the RAM 53.

In Step 240, printing corresponding to a single line is performed. It is the head portion of the printing data which have not been printed yet that is to be printed in this Step 240.

In Step 250, it is determined if any printing data which have not been printed yet are present or not. If YES, the program proceeds to Step 150, while it proceeds to Step 260 if No.

In Step 260, the feed motor 62 is driven by a specified amount for discharging the paper P to the downstream side of the transfer path 4.

On the other hand, when it is determined NO in Step 180 (that is, when the rear end of the paper P has passed the paper end detecting sensor 42), the program proceeds to Step 270. In Step 270, the feed motor 62 is driven for a single pulse time for transferring the paper P.

In Step 280, it is determined whether the number of times transfer by a single pulse (Step 170 or Step 270) has been executed after the immediately preceding printing (any one of Step 140, Step 240 and Step 290) has reached the average number of pulses for line break as set in Step 230. If it is determined YES, the program proceeds to Step 290. If it is determined NO, the program proceeds to Step 270.

In Step 290, printing of a single line is executed. It is the head portion of the printing data which have not been printed yet that is printed in this Step 290.

In Step 300, it is determined whether the number of times the above Step 270 has been executed since it was determined NO in Step 180 has reached a specified number of pulses for rear end transfer (that is, whether printing has been completed up to the rear end of the paper P). If NO, the program proceeds to Step 310, while if YES, it proceeds to Step 260.

In Step 310, it is determined whether any printing data that have not been printed yet are present or not. If YES, the program proceeds to Step 270, while if NO, it proceeds to Step 260.

With the above arrangement, transfer of the paper P will be controlled on the basis of the average number of pulses for line break up to that time after the rear end of the paper P has passed the paper end detecting sensor 42 so that no inconveniences will be caused in printing even if the rear end of the paper P should pass through the idle roller 72 thereafter.

Figure 7B:
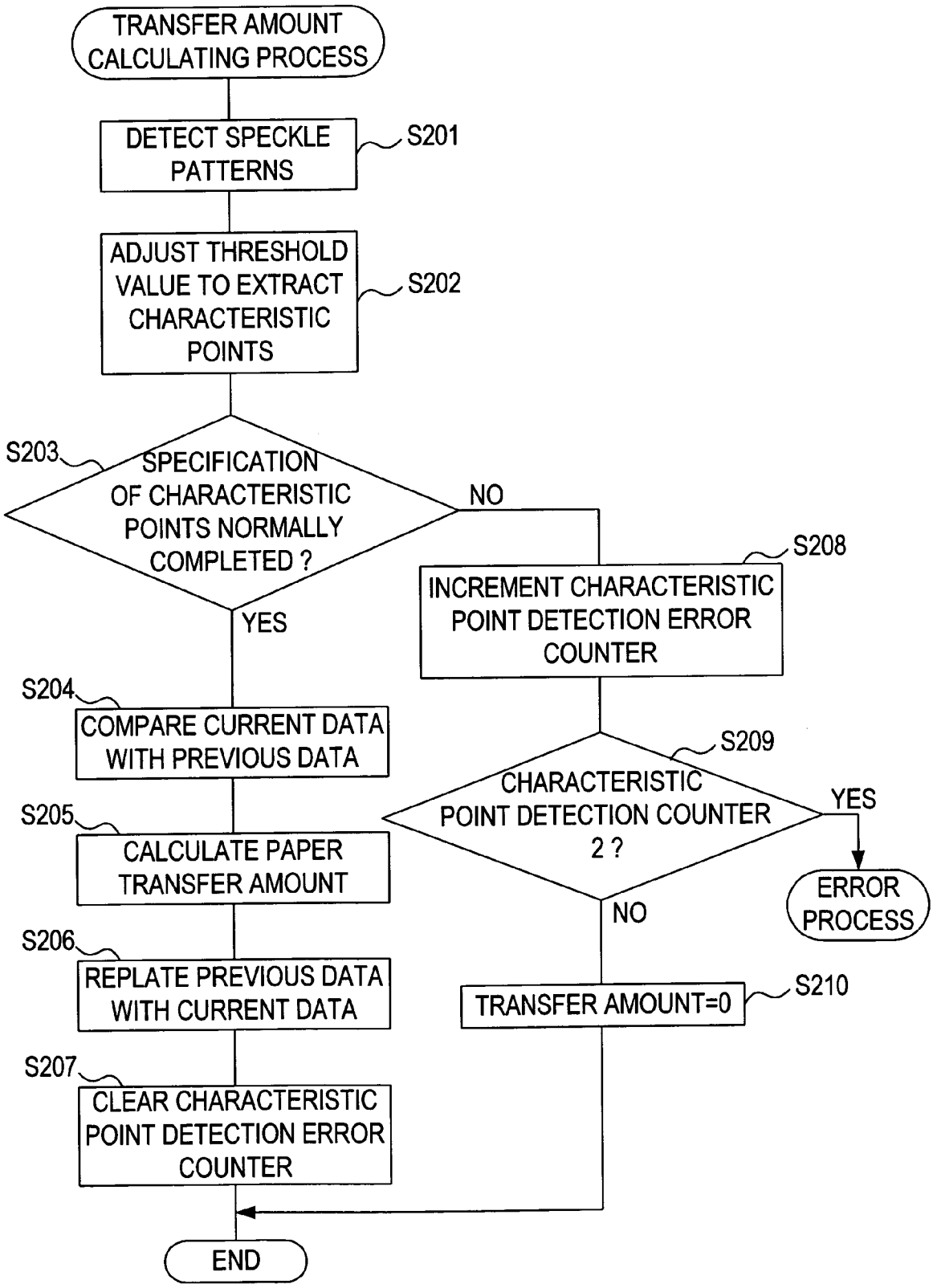
FIG. 7B is a flowchart illustrating the details of the processes performed in Step 200 of FIG. 7A.

The process in Step 200 will now be explained in further detail with reference to FIG. 7B.

The motion sensor 70 detects the speckle patterns continuously and sends information about the speckle patterns converted into digital signals through the amplifier 67 and the A/D converter 66 to the correlator 54 (S201).

The correlator 54 adjusts the threshold value to extract characteristic points (S202), and specifies several characteristic points (S203).

If the specification of characteristic points is normally completed (S203: YES), the moving direction and the moving amount of the characteristic points are calculated based on the speckle pattern information and the resolution of the photoreceptor by comparison between the previous data and the current data of the characteristic points which move in accordance with the movement of the observing object (S204). Subsequently, by multiplying the moving amount calculated in S204 by a correction factor with respect to the actual moving amount of the paper, the transfer amount is calculated (S205). After the current data about the characteristic points is stored so as to replace the previous data about the characteristic points (S206), a characteristic point detection error counter (explained in detail later) is cleared (S207) and the entire process is terminated.

If the specification of characteristic points is not normally completed (S203: NO), for example, if characteristic points cannot be specified in the speckle pattern information in spite of adjusting the threshold value because of the influence of noises, the characteristic point detection counter for counting the number of characteristic points detection errors is incremented (S208).

If the indication of the characteristic point detection counter is more than 2, that is, the characteristic point detection ends up with three consecutive errors (S209: YES), a moving amount detection error is determined and the user is informed of the error so as to perform error handling such as stopping the operation of the device. On the other hand, if the indication of the characteristic point detection counter is equal to or less than 2 (S209: NO), the moving amount is determined 0 without calculating the moving amount (S210) and the process is terminated.

Thus, it is possible to prevent an incorrect moving amount provided by a detection error from being used for input of feedback control.

The above described processes are executed at each sampling frequency for calculation of the moving amount. The sampling frequency for calculation of the moving amount is set within a time short enough for the characteristic points not to move out of a detection area detected by the photoreceptor even when the paper is moved at a predetermined maximum speed.

f) Effects i) to xvi) that are exhibited by the ink jet printer 1 of the present Embodiment 1 will now be explained.

According to the ink jet printer 1 of the present Embodiment 1, laser light reflected by the idle roller 72 is received, and transfer of paper P is controlled by using the speckle patterns generated in the reflected light.

Accordingly, the contrast of reflected laser light will not be changed owing to types and conditions of paper P (color, roughness, transparency, etc.), so that it is possible to recognize speckle patterns in a constantly accurate manner, and it is accordingly possible to accurately control transfer of paper P.

ii) According to the ink jet printer 1 of the present Embodiment 1, a portion at which laser light will be reflected (the second outer diameter portion 72*b* of the idle roller 72) will not contact paper P so that it will not be stained by paper P or ink, and it will not be worn through contact with the paper P nor will its surface shape (minute concaves and convexes) be changed with time.

Accordingly, no degradation in contrast of speckle patterns generated in reflected light will be caused so that it is possible to control transfer of paper P in a constantly accurate manner.

iii) According to the ink jet printer 1 of the present Embodiment 1, paper P will be transferred at rapid speed through normal motor control during a period of time from taking the paper P out from the paper feed cassette 11 up to a point at which the head of the printing area of the paper P reaches right under the printing head 36 and after completion of printing (after completion of printing corresponding to printing data or after performing printing to the last of the printing area of the paper P).

While performing printing, transfer of the paper P is controlled in a highly accurate manner on the basis of digital signals output from the motion sensor 70.

In other words, during the printing processes in which highly accurate transfer of paper is required, transfer is performed by using the motion sensor 70, while the paper P is transferred at rapid speed through normal motor control during a period in which accuracy of paper transfer is not so much required prior to starting printing and after completion of printing) to thereby achieve both, highly accurate printing and shortening of printing time.

iv) Since the idle roller 72 is provided upstream of the print mechanism 30 in the ink jet printer 1 of the present Embodiment 1, the paper P that contacts the idle roller 72 has not undergone any printing yet.

Accordingly, the idle roller 72 is prevented from being stained by ink applied onto the paper P and reflected light from the idle roller 72 includes constantly clear speckle patterns.

Transfer of the paper P can accordingly be accurately controlled.

v) According to the ink jet printer 1 of the present Embodiment 1, reflected light from the idle roller 72 that rotates accompanying the transfer of the paper P is utilized for calculating a transfer amount of the paper P.

The idle roller 72 that rotates accompanying the transfer of the paper P is less apt to cause slips between the outer peripheral surface of the roller and the contact surface of the paper P when compared to a roller to which driving force is transmitted from the feed motor 62 so that the rotating amount of the idle roller 72 is accurately illustrative of the transfer amount of the paper P.

Since the present Embodiment 1 is thus arranged in that the transfer amount the paper P is calculated on the basis of the rotating amount of the idle roller 72 that is accurately illustrative of the transfer amount of the paper P, the transfer amount of the paper P can be accurately calculated and it is consequently possible to accurately perform control of transfer of the paper P.

vi) According to the ink jet printer 1 of the present Embodiment 1, the idle roller 72 is provided above the paper P so that stains caused by the paper P will hardly be accumulated on the idle roller 72.

Since the surface of the idle roller will thus be maintained clean, reflected light from the idle roller 72 will include constantly clear speckle patterns.

Accordingly, transfer of the paper P can be accurately controlled.

vii) According to the ink jet printer 1 of the present Embodiment 1, all of the paths of laser light within the motion sensor 70 (the semiconductor laser 74, points at which laser light is reflected by the idle roller 72 and the two-dimensional semiconductor image sensor 76) are housed inside of the housing 73.

Accordingly, leakage of laser light to the exterior of the housing 73 can be prevented so as to cause no damages to human bodies through the laser light.

viii) According to the ink jet printer 1 of the present, Embodiment 1, the laser light within the motion sensor 70 is irradiated downward.

Accordingly, if it should happen that the direction of the semiconductor laser 74 is deviated to cause leakage of laser light to the exterior of the motion sensor 70, possible influences on human bodies can be reduced.

ix) It is a member having two-dimensionally arranged pixels (the two-dimensional semiconductor image sensor 76) that receives the reflected light in the motion sensor 70 of the ink jet printer 1 of the present Embodiment 1.

Since speckle patterns generated by the reflected light may thus be detected as two-dimensional images, it is possible to perform accurate comparison of speckle patterns by the correlator 54.

x) According to the ink jet printer 1 of the present Embodiment 1, the idle roller 72 is provided in a freely rotating manner in the vertical direction with respect to the surface of the paper P and is pressed against the paper P at constant pressure.

Accordingly, a change in thickness of the paper P will cause a corresponding change in the position of the idle roller 72 (position in the vertical direction of the paper P) so that the pressing pressure applied to the paper P will be maintained constant.

As a result, the idle roller 72 will constantly rotate smoothly accompanying the transfer of the paper P without being dependent on the thickness of the paper P so that the motion sensor 70 and the control portion 50 will be able to constantly calculate an accurate transfer amount of the paper P.

x) According to the motion sensor 70 of the ink; jet printer 1 of the present Embodiment 1, the semiconductor laser 74, the idle roller 72 and the two-dimensional semiconductor image sensor 76 are arranged such that their positional relationship is maintained constant, and laser light that has been irradiated from the semiconductor laser 74 will thus reach the two-dimensional semiconductor image sensor 76 constantlythrough a constant path.

It is accordingly possible to constantly calculate an accurate transfer amount of the paper P.

xii) According to the ink jet printer 1 of the present Embodiment 1, it is possible to accurately detect the moving amount of the idle roller 72 by extracting characteristic points or characteristic patterns to detect the moving amount from surface condition signals obtained from the results of reading speckle patterns appearing on the surface of the idle roller 72, and by comparing the previous position and the current position of the characteristic points or characteristic patterns.

xiii) According to the ink jet printer 1 of the present Embodiment 1, it is possible to further accurately detect the moving amount of the idle roller 72 as an observation object since the motion sensor 70 as surface condition signal generating means has a measurement range in which a plurality of moving amount detecting operations can be performed even when the idle roller 72 moves at a predetermined maximum speed, and thus the correlation between the surface condition signals can be found out without fail.

xiv) According to the ink jet printer 1 of the present Embodiment 1, it is possible to accurately detect the moving amount of the idle roller 72 even when characteristic points for comparison cannot be found, by discarding the obtained surface condition signals without adding an incorrect moving amount because the moving amount itself is observed, unlike the case with control using an encoder.

xv) According to the ink jet printer 1 of the present Embodiment 1, it is possible to inform the user that normal transfer is not performed by indicating an error when extraction of characteristic points is failed a number of consecutive times and thus failures of the motion sensor 70 or defects of the transfer mechanism 20 may be suspected.

xvi) According to the ink jet printer 1 of the present Embodiment 1, it is possible to further accurately detect the moving amount of the idle roller 72 by setting the size of characteristic points or characteristic patterns extracted by the moving sensor 70 such that the characteristic points or characteristic patterns are within the measurement range of the motion sensor 70 even when at least two consecutive times of moving amount detecting operations are performed, and thereby enabling the comparison of the previous and the current positions as long as the observation object moves within a predetermined speed range.

(Embodiment 2)

Figure 9:
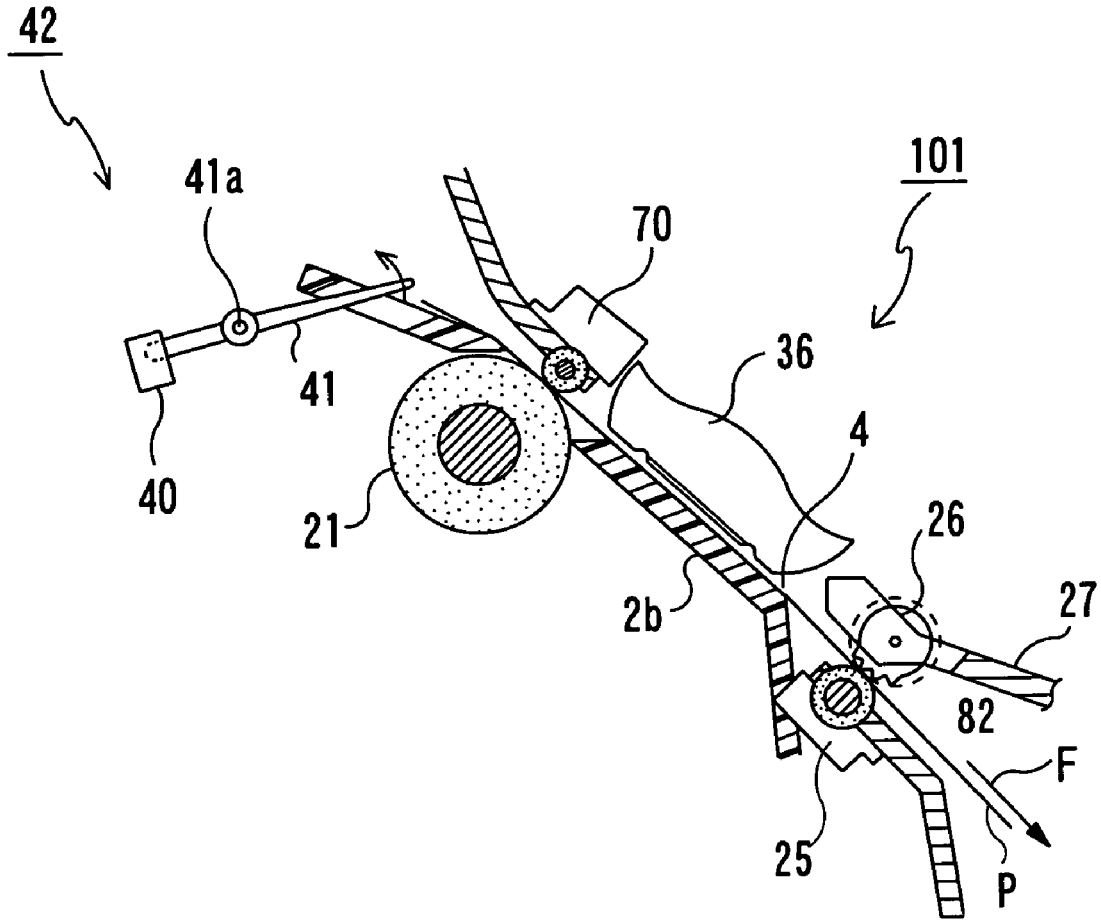
FIG. 9 is a sectional view illustrating the peripheral portion of a paper transfer mechanism of an ink jet printer of Embodiment 2.

The structure of an ink jet printer 101 according to Embodiment 2 will now be explained with reference to FIG. 9. It should be noted that explanations of portions that are similar to those of Embodiment 1 will be omitted hereinafter.

The structure of the ink jet printer 101 is, in general, similar to that of the ink jet printer 1 of the above Embodiment 1.

However, the ink jet printer 101 of the present Embodiment 2 is provided with a motion sensor 80 on the downstream side of the print mechanism 30 in addition to the motion sensor 70 on the upstream side of the print mechanism 30.

While the structure of the motion sensor 80 on the downstream side is, in general, similar to the structure of the motion sensor 70 on the upstream side, it is different therefrom in that it is provided under the paper P.

More particularly, an idle roller 82 of the notion sensor 80 on the downstream side is provided to be coaxial with the second transfer roller 25 and is provided to face the spur rollers 26 across and from under the paper P.

In the motion sensor 80 on the downstream side, the idle roller 82 rotates upon transmission of driving force from the drive mechanism, similarly to the second feed roller 25.

Figure 10:
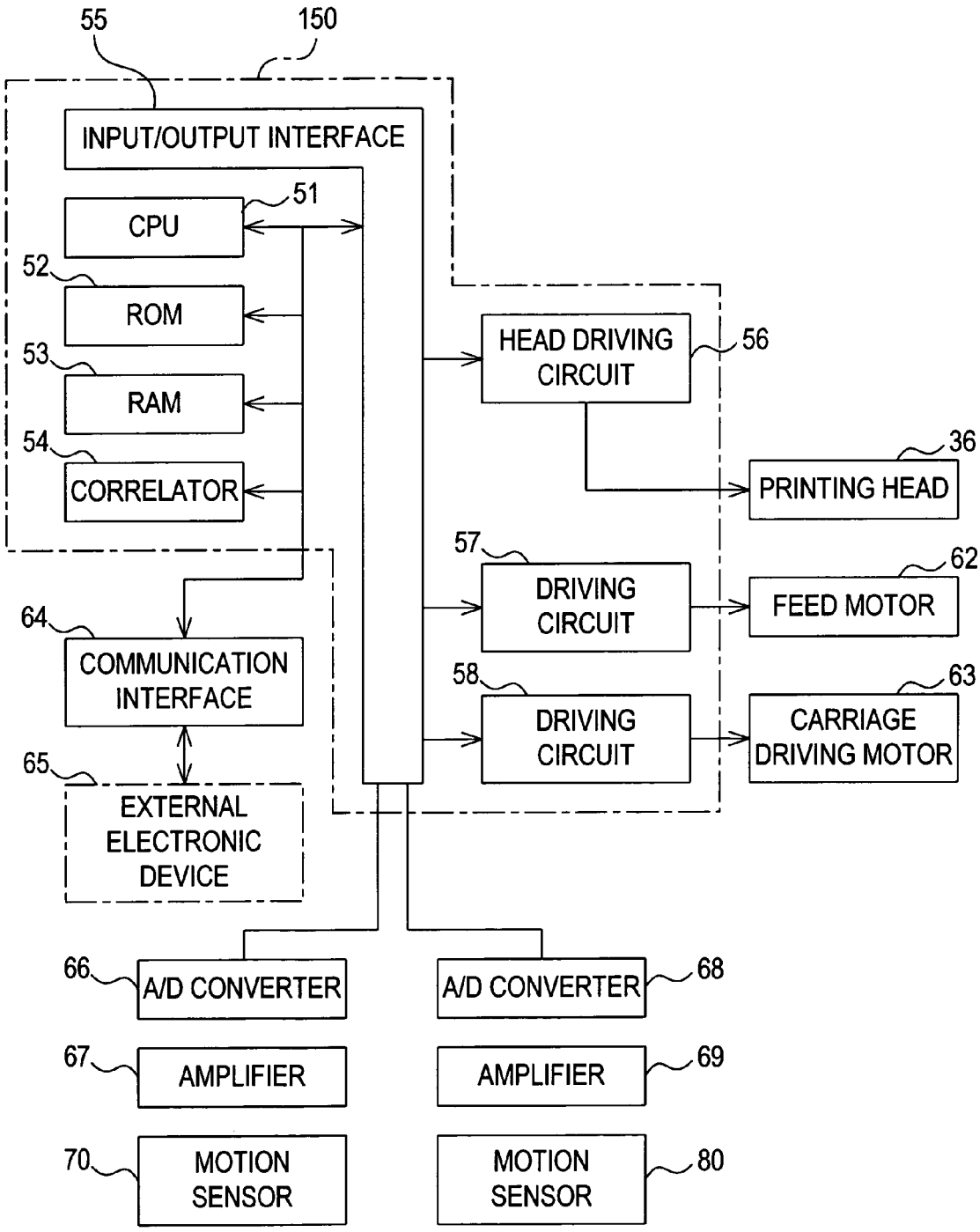
FIG. 10 is a block diagram illustrating the structure of a controller of the ink jet printer of Embodiment 2.

A controller 160 of the ink jet printer 101 will now be explained with reference to FIG. 10.

The controller 150 of the present Embodiment 2 is, in general, similar to the controller 50 of Embodiment 1.

However, in the controller 150 the motion sensor 80 on the downstream side (rear motion sensor) is connected through amplifier 69 and A/D converter 68 in addition to the motion sensor 70 on the upstream side (front motion sensor).

Figure 11A:
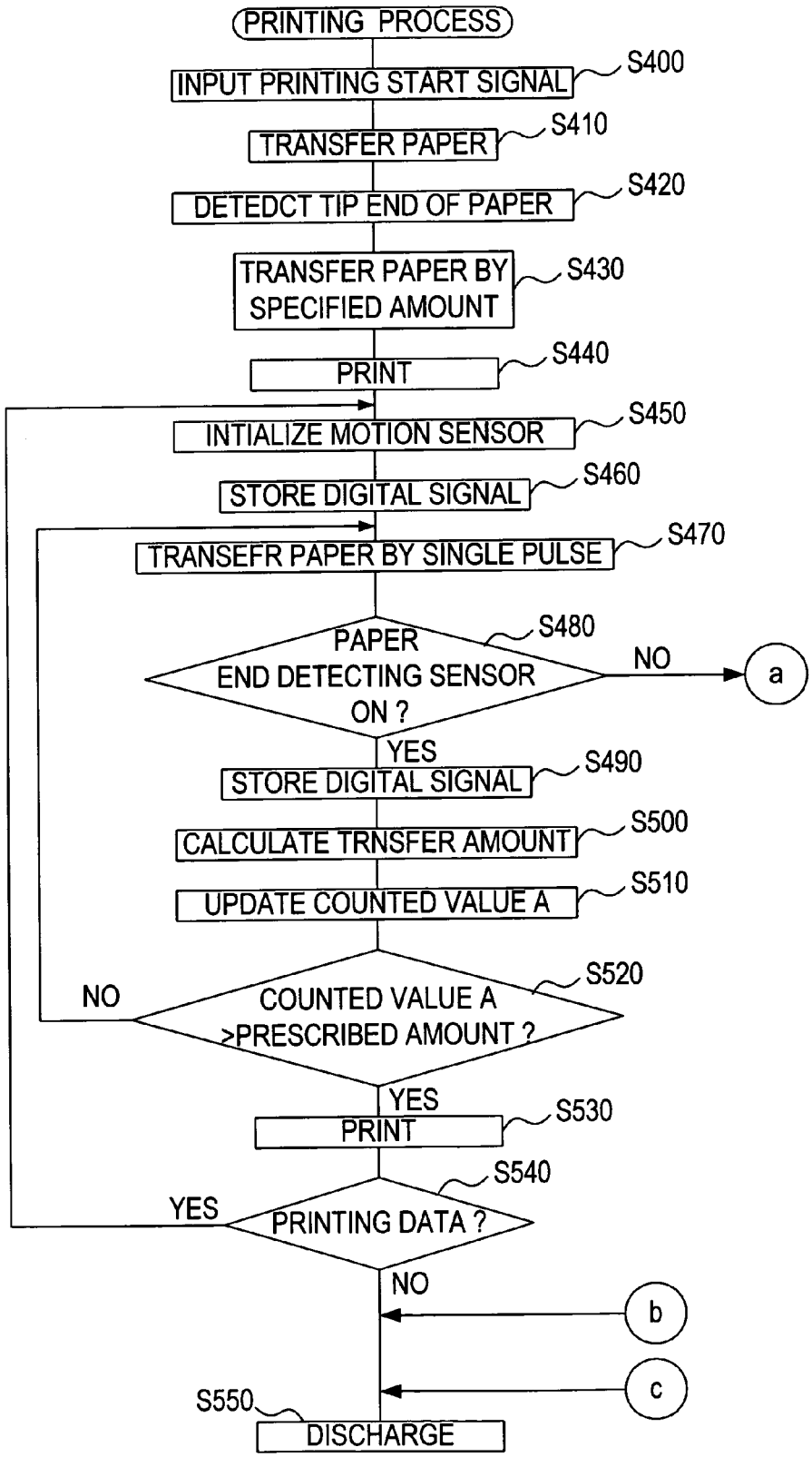

Next, printing processes performed in the ink jet printer 101 will now be explained with reference to FIGS. 11A and 11B.

While the printing processes of the ink jet printer 101 are, in general, similar to the printing processes of the ink jet printer 1 of Embodiment 1, they differ in that transfer of the paper P is controlled by using digital signals that are detected by the motion sensor 80 on the downstream side after the rear end of the paper P in the transferring direction thereof has passed the motion sensor 70 on the upstream side.

The printing processes of the ink jet printer 101 will now be concretely explained with reference to FIGS. 11A and 11B. It should be noted that only brief explanations will be made for portions that are similar to the printing processes of the ink jet printer 1 of Embodiment 1.

In Step 400, a printing start signal and printing data are input from the external electronic device 65 to the controller 150 through the interface for communication 64. The printing data are stored in the RAM 53.

In Step 410, paper P is taken out from the paper feed cassette 11 and is transferred along the transfer path 4.

Upon detection of a tip end of the paper P by the paper end detecting sensor 42 in Step 420, in Step 430, the paper feed roller 14 further rotates by a specified amount so that the tip end of the paper P hits against a nip of the first transfer roller 21 and the follower roller 22 to cause so-called resist actions; thereafter, upon rotational driving of the feed motor 62 in the reverse direction, the first transfer roller 21, which has so far been rotating in a counter-clockwise direction in FIGS. 1 and 2, starts to rotate in a clockwise direction by a specified amount (prescribed amount for tip end) to transfer the paper P until the head of a printing area of the paper P is placed right under the printing head 36 of the print mechanism 30. Thereafter, the first transfer roller, 21 and the paper P temporarily stop.

In Step 440, printing of the printing data corresponding to the first line is performed by using the print mechanism 30 with the paper P in a suspended condition.

In Step 450, a counted value A stored in the RAM 53 is reset as a preparation of executing a process to be discussed later. The counted value, which is a parameter that is counted up on the basis of signals output from the motion sensor 70, will be described later in detail.

In Step 460, a digital signal (surface condition signal) related to the surface condition of the idle roller 72 and, accordingly, to the position of the paper P is detected by using the motion sensor 70 and is stored in the RAM 53.

In Step 470, the paper P is transferred in the downstream direction by driving the feed motor 62 by a single pulse. It should be noted that the idle roller 72 is also rotated by a specified amount accompanying the transfer of the paper P.

In Step 480, it is determined whether the paper end detecting sensor 42 is ON or not (that is, whether the rear end in the transferring direction of the paper P has not yet passed the paper end detecting sensor 42 or already has), and the program proceeds to Step 490 when YES. On the other hand, when NO, the program proceeds to Step 560.

In Step 490, a digital signal (paper position signal) related to the surface condition of the idle roller 72 and, accordingly, to the position of the paper P is stored in the RAM 53, similarly,to the above Step 460.

In Step 500, the newest signal and the next newest signal among the digital signals that have been stored in the RAM 53 either in Step 460 or in Step 490 are used for performing calculation in the correlator 54 and the transfer amount by which the paper P has been transferred in the transferring direction in Step 470 is calculated. The calculation of transfer amount in Step 500 includes similar processes to those in Step 200 (S201–S210).

In Step 610, the transfer amount of the paper P as calculated in Step 500 is added to the counted value A, which is a parameter stored in the RAM 53 (accumulated value of the transfer amount of paper P at the time the above Step 510 has been executed) for updating the counted value. It should be noted the counted value A is a value that is reset in Step 450 as already discussed.

In Step 520, it is determined whether the counted value A that has been updated in Step 510 has reached a prescribed amount for line break (the length of the nozzle portions of the printing head 36: for instance, 1 inch). If the prescribed amount for line break has been reached, the program proceeds to Step 530, while if the prescribed amount for line break has not been reached yet, the program proceeds to Step 470.

In Step 530, printing corresponding to a single line is performed. It is the head portion of the printing data which have not been printed yet that is to be printed in this Step 530.

In Step 540, it is determined if any printing data that have not been printed yet are present or not. If YES, the program proceeds to Step 450, while it proceeds to Step 550 if NO.

In Step 550, the feed motor 62 is driven by a specified amount for discharging the paper P toward the downstream side of the transfer path 4.

On the other hand, when it is determined NO in Step 480 (that is, when the rear end of the paper P has passed the paper end detecting sensor 42), the program proceeds to Step 560. In Step 560, the counted value B as stored in the RAM 53 is reset as a preparation of executing a process to be discussed later. The counted value B, which is a parameter that is counted up on the basis of signals output from the motion sensor 80, will be described later in detail.

In Step 570, a digital signal (surface condition signal) related to the surface condition of the idle roller 72 and, accordingly, to the position of the paper P is detected by using the motion sensor 80 and is stored in the RAM 53.

In Step 580, the feed motor 62 is driven for a signal pulse time.

In Step 590, a digital signal (surface condition signal) related to the surface condition of the idle roller 72 and, accordingly, to he position of the paper P is detected similarly to Step 570 and is stored in the RAM 53.

In Step 600, the newest signal and the next newest signal-among the digital signals that have been stored in the RAM 53 either in Step 570 or in Step 590 are used for performing calculation in the correlator 54 and the transfer amount by which the paper P has been transferred in the transferring direction in Step 580 is calculated.

In Step 610, the transfer amount of the paper P as calculated in Step 600 is added to the counted value B, which is a parameter stored in the RAM 53 (accumulated value of the transfer amount of the paper P at the point of time when Step 610 was executed the last time), to update the counted value B. It should be noted that the counted value B is a value that is reset in Step 560, as already discussed.

In Step 620, it is determined whether or not it is the first time the Step 620 has been reached since the printing processes was started. If NO, the program proceeds to Step 630, while it proceeds to Step 670 if YES.

In Step 630, it is determined whether the counted value B has reached a prescribed amount for line break. If the prescribed amount for line break has been reached, the program proceeds to Step 640, while if the prescribed amount for line break has not been reached yet, the program proceeds to Step 580.

In Step 640, printing corresponding to a single line is performed. It is the head portion of the printing data which have not been printed yet that is to be printed in this Step 640.

In Step 650, it is determined whether or not the number of times Step 580 has been executed since it was determined NO in Step 480 has reached a specified number of pulses for rear end transfer (that is, whether printing has been completed up to the rear end of the paper P). If NO, the program proceeds to Step 660, while if YES, it proceeds to Step 550.

In Step 660, it is determined whether any printing data that have not been printed yet are present or not. If YES, the program proceeds to Step 560, while if NO, it proceeds to Step 550.

On the other hand, if it is determined YES in Step 620 (that is, the rear end of the paper P has passed the paper end detecting sensor 42 during a line break), the program proceeds to Step 670. In Step 670, it is determined whether or not the sum of the counted value A and the counted value B has reached a prescribed amount for line break. If the prescribed amount for line break has been reached, the program proceeds to Step 640, while if the prescribed amount for line break has not been reached, the program proceeds to Step 580.

Effects exhibited by the ink jet printer 101 of the present Embodiment 2 will now be explained.

i) Since the ink jet printer 101 of the present Embodiment 2 includes all the structures of the ink jet printer 1 of Embodiment 1, it exhibits the same effects as the Embodiment 1.

ii) Moreover, by the provision of the motion sensor 80 on the downstream side in addition to the motion sensor 70 on the upstream side, the ink jet printer 101 of the present Embodiment 2 is capable of performing accurate printing over the entire printing area of the paper P.

More particularly, since the position of the paper P may be detected by using the motion sensor 80 on the downstream side also after the rear end of the paper P has passed the motion sensor 70 on the upstream side, it is possible to accurately detect the position of the paper P over the entire paper P and to control transfer of the paper P on the basis of the detected signals thereof (surface condition signals).

iii) Since the roller 82 contacts the lower surface of the paper P (reverse side of the surface on which printing is performed) in the motion sensor 80 on the downstream side, the roller will not be stained by ink applied onto the paper P, it is possible to perform constantly accurate detection.

(Embodiment 3)

While a stepping motor is used as the feed motor 62 in Embodiment 1 and Embodiment 2, a DC motor is employed in Embodiment 3.

Figure 12:
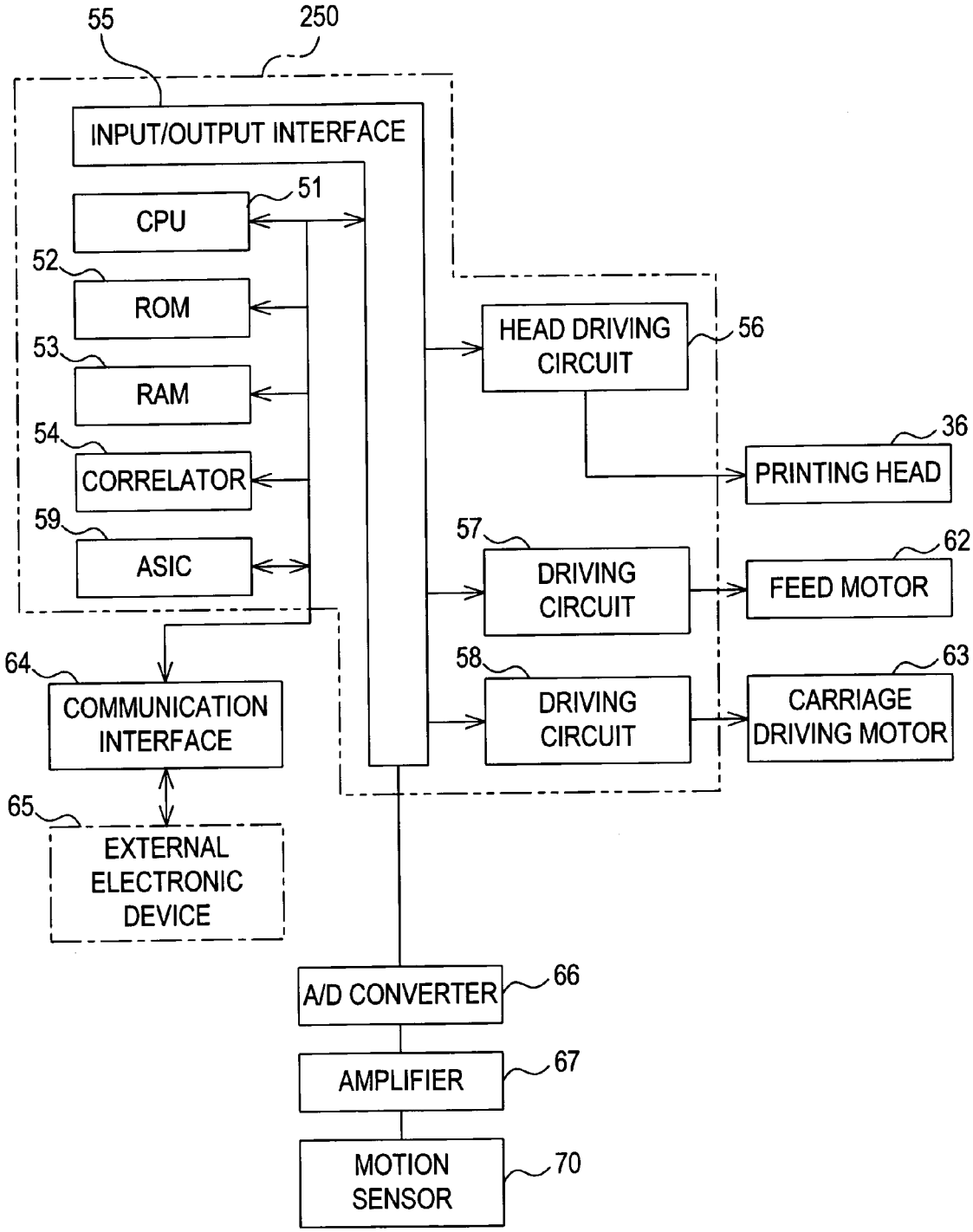
FIG. 12 is a block diagram illustrating the structure of a controller of an ink jet printer of Embodiment 3.

In the present Embodiment 3, as illustrated in FIG. 12, a controller 250 comprises an ASIC 59, which is provided with a circuit for controlling the DC motor driving by closed-loop system, in addition to the controller 50 driven by a stepping motor as described above. Since all the components except for the ASIC 59 have already be explained above, a further explanation thereof will not be given.

Figure 13:
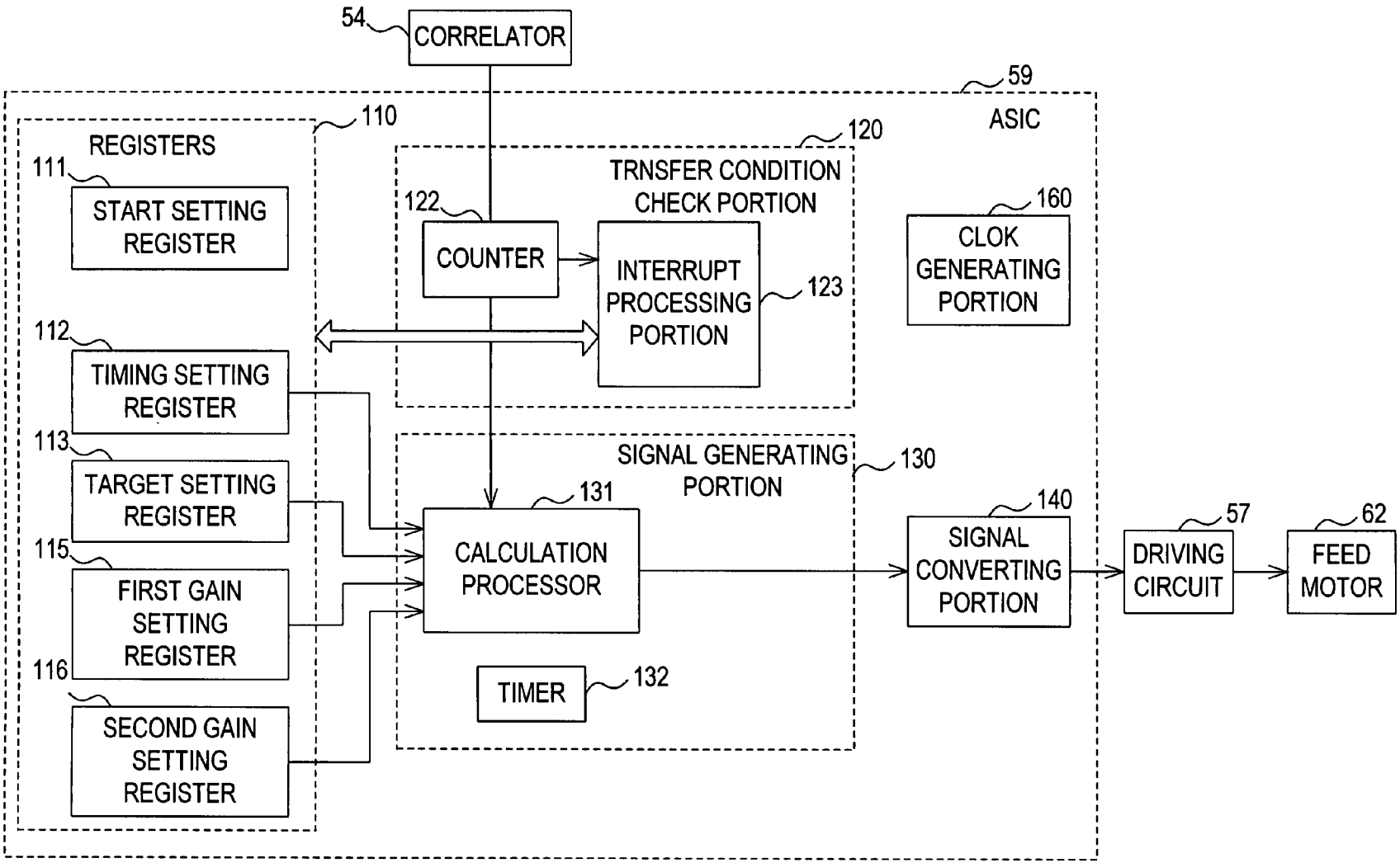
FIG. 13 is a block diagram illustrating the internal structure of an ASIC in Embodiment 8.

The internal structure of the ASIC 59 will be explained with reference to FIG. 13. A signal generating circuit 100 in the ASIC 59 comprises a group of registers 110, a transfer condition check portion 120 for checking the transfer condition based on the information about the moving amount input from the correlator 54, a signal generating portion 130 for generating control signals to control the feed motor 62, a signal converting portion 140 for converting the control signals generated by the signal generating portion 130 into PWM signals and a clock generating portion 150 capable of supplying clock signals to the entire signal generating circuit 100.

The group of registers 110 comprises a start setting register 111, a timing setting register 112 for setting a time for calculation $t_0$ indicating the timing for performing the after-mentioned procedure of generating the control signals (FIG. 14), a target setting register 113 for setting a moving amount r corresponding to a target transfer amount R as a target transfer amount of the paper, a first gain setting register 115 for setting a integral gain F1 and a state feedback gain F2 to be used when the signal generating portion 130 generates the control signals and a second gain setting register 116. The start setting register 111 is a register into which an order to start the signal generating circuit 100 is written. When such an order is written into the start setting register 111, the entire signal generating circuit 100 is started.

The transfer condition check portion 120 comprises a counter 122 for counting the current position of the paper based on the information about the moving amount input from the correlator 54 and an interrupt processing portion 123 for outputting a stop interrupt signal to the CPU 51 when the transfer amount of the paper has reached the target transfer amount. The interrupt processing portion 123 outputs a stop interrupt signal when the counted value y has reached or exceeded the target value r previously set in the target setting register 113, or when a predetermined time has elapsed since the counted value y reached the target value r.

The counter 122 counts the current position of the paper based on the information about the moving amount obtained from the correlator 54 at specified time intervals on the basis of the clocks supplied from the clock generating portion 150.

The signal generating portion 130 comprises a calculation processor 131 for generating control signals to control the feed motor 62 and a timer 132 for counting time based on the clock signals generated by the clock generating portion 150.

Figure 14:
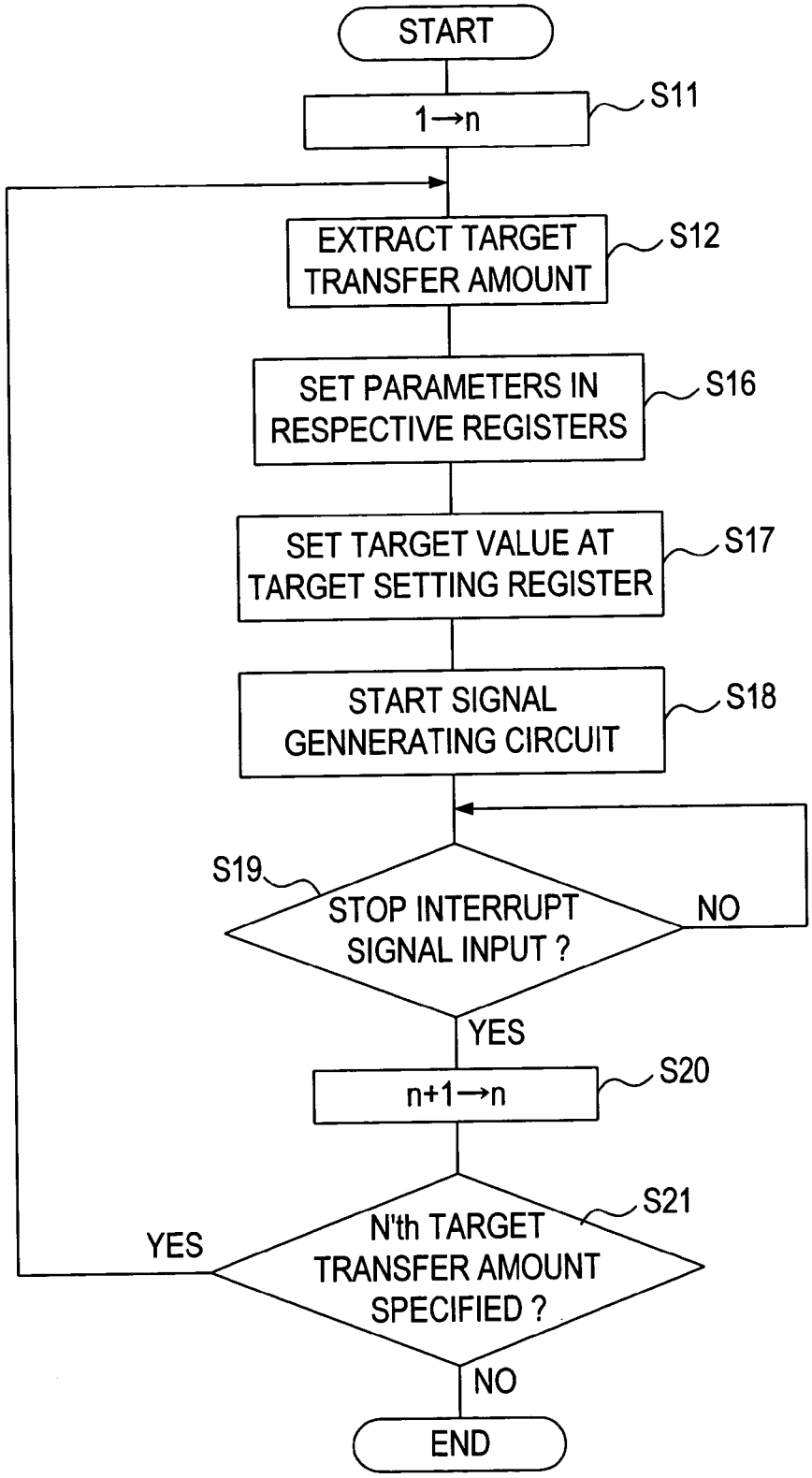
FIG. 14 is a flowchart illustrating the paper transferring process performed by a CPU in Embodiment 3.

The paper transfer processes performed by the CPU 51 will be explained with reference to FIG. 14. The paper transfer processes are started when printing data are received through the interface for communication 64.

First, the CPU 51 performs initialization process (s11).

In this process, "1" is put into variable n (1→n). Hereinafter "n" indicates a value set to a variable n.

Next, the CPU 51 extracts a target transfer amount specified by the printing data (s12). In this process, the n'th target transfer amount E is extracted from among a plurality of the target transfer amounts specified by the printing data.

Subsequently, the CPU 51 sets parameters in respective registers in the group of registers 110 (s16). In this process, a time for calculation $t_0$ is set in the timing setting register 112, an integral gain F1 is set in the first gain setting register 115 and a state feedback gain F2 is set in the second gain setting register 116. The larger the target transfer amount R is, the integral gain F and the state feedback gain F2 having larger absolute values are set at the respective gain setting registers 115, 116.

Then, the CPU sets a target value r at the target setting register 113 in the group of registers 110 (s17).

The CPU 51 starts the signal generating circuit 100 (s18). In this process, writing into the start setting register 111 constituting the group of registers 110, and thereby the entire signal generating circuit 100 is started.

After the signal generating circuit 100 is started, the signal generating portion 130 constituting the signal generating circuit 100 generates a control signal according to the after-mentioned procedure of generating a control signal. When the control signal is input to the transfer driving circuit 57 through the signal converting portion 140, the feed motor 62 starts transfer of paper. When the transfer amount of the paper has reached the target transfer amount after the control signal is repeatedly input to the transfer driving circuit 57, a stop interrupt signal is output from the interrupt processing portion 123 in the transfer condition check portion 120 constituting the signal generating circuit 100.

The CPU 51 waits until the stop interrupt signal is input from the interrupt processing portion 123 in the transfer condition check portion 120 (s19: NO). When receiving the stop interrupt signal (s19: YES), the CPU 51 adds "1" to the variable n (n+1→n) (s20).

If the n'th target transfer amount is specified (s21: YES), the CPU 51 returns to the process in s11, and performs the processes from s11 through s21 with respect to the entire target transfer amounts specified by the printing data (s21: NO), then ends the present paper transfer processes.

[The Procedure of Generating a Control Signal by the Signal Generating Portion 130]

Figure 15:
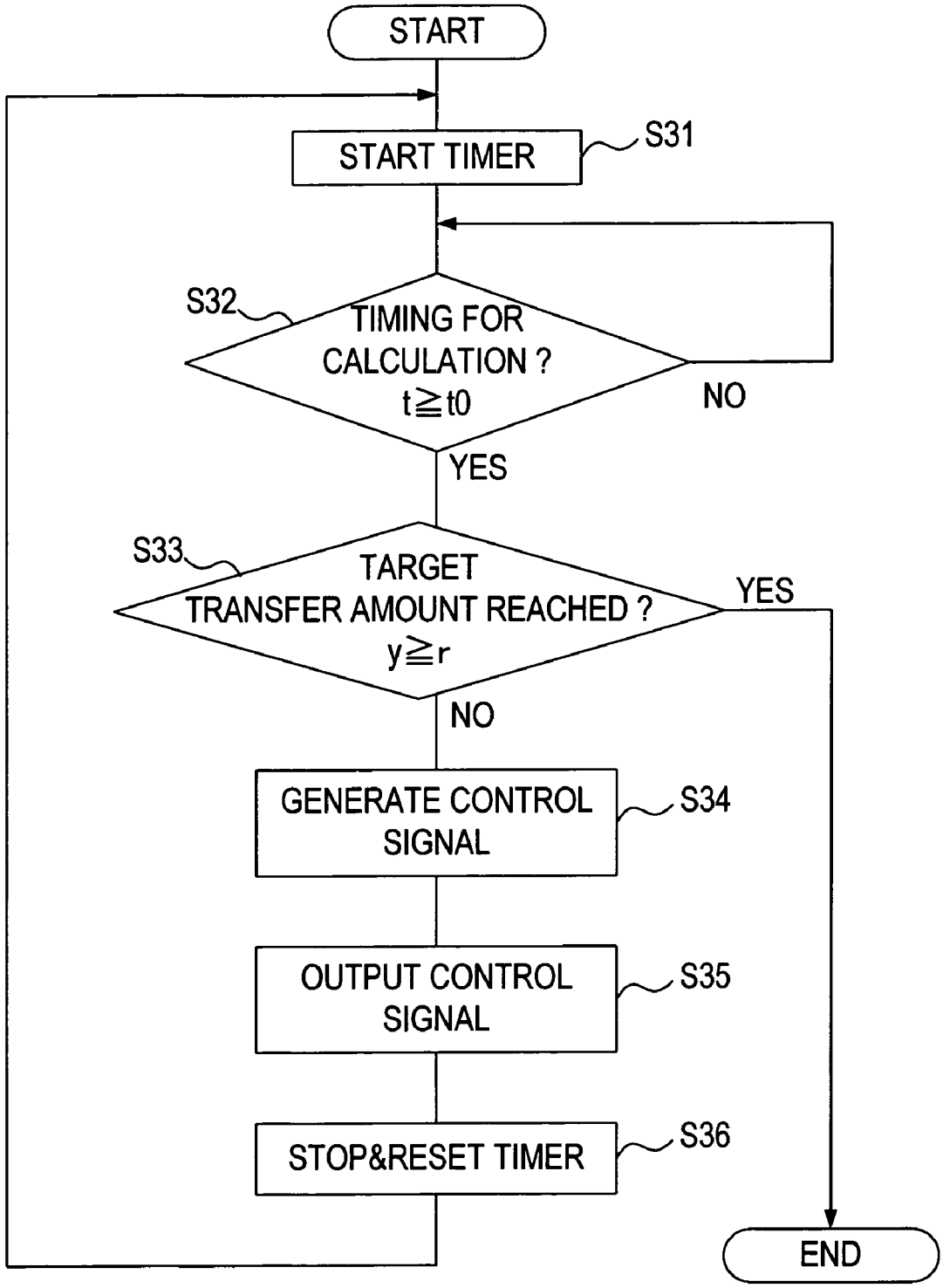
FIG. 15 is a flowchart illustrating the control signal generating process performed by a signal generating portion of a signal generating circuit in Embodiment 3.

The procedure of generating a control signal by the signal generating portion 130 in the signal generating circuit 100 will now be explained with reference to FIG. 15. Generation of the control signal according to the procedure is started after writing into the start setting register 111 is performed in the process of s18 in FIG. 14. The signal generating circuit 100, which is comprised of a so-called ASIC and operates as a hardware, will be explained by illustrating the operation as a hardware in the form of a flowchart to facilitate better understanding.

First, the signal generating portion 130 starts the timer 132 (s31).

Next, the signal generating portion 130 waits until the timing for calculation has been reached (s32: NO), i.e. the measured time t measured by the timer 132 has reached the time for calculation $t_0$ set in the timing setting register 112 ($t<t_0$).

When the timing for calculation has been reached in the process in s32 (s32: YES), the signal generating portion 130 checks whether or not the transfer amount of paper has reached the target transfer amount (s33) by comparing the counted value y counted by the counter 122 and the target value r set in the target setting register 113. If the counted value y is smaller than the target value r ($y<r$), it is determined that the transfer amount of paper has not reached the target transfer amount, while if the counted value y is equal to or more than the target value r ($y \geqq r$), it is determined that the transfer amount of paper has reached the target transfer amount.

Figure 16:
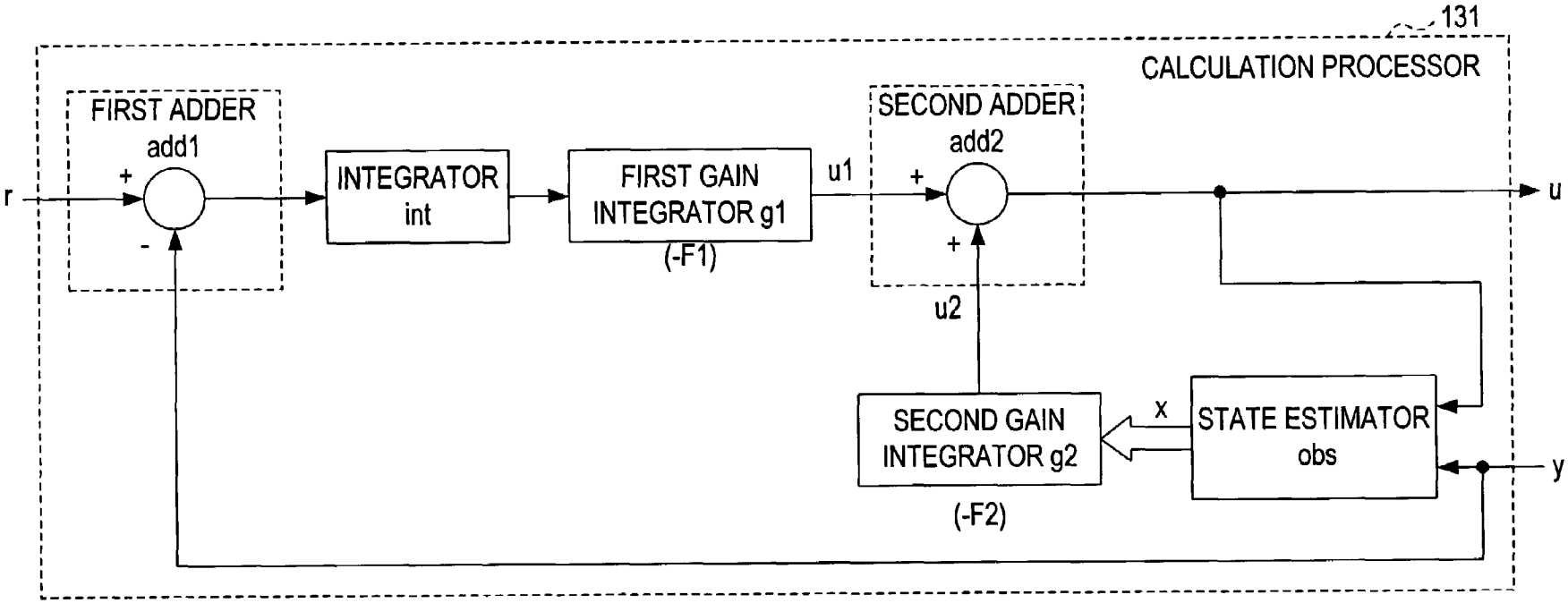
FIG. 16 is a block diagram illustrating the control signal generating process performed by a calculation processor of a signal generating circuit in Embodiment 3.

If it is determined in the process in s33 that the transfer amount of paper has not reached the target transfer amount (s33: NO), the signal generating portion 130 generates, by the calculation processor 131, a control signal to be input to the transfer driving circuit 57 (s34). The detailed procedure of generating the control signal by the calculation processor 131 will be explained later in [Generation of Control Signal by the Calculation Processor 131] (FIG. 16).

Subsequently, the signal generating portion 130, outputs the control signal to the signal converting portion 140 (s35). The signal converting portion 140 to which the control signal is input converts the control signal into a PWM signal and outputs the PWM signal to the transfer driving circuit 57.

The signal generating portion 130 then stops and resets the timer 132 (s36), and returns to the process in s31.

When it is determined in the process in s33 that the transfer amount of paper has reached the target transfer amount after the processes from s31 through s36 are repeatedly performed (s33: YES), the present procedure of generating a control signal is terminated.

[Generation of Control Signal by the Calculation Processor 131]

The procedure of generating a control signal by the calculation processor 131 will now be explained with reference to FIG. 16. The calculation processor 131 of the signal generating portion 130, which is for performing feedback control such that the counted value y by the counter 122 equals to the target value r set in the target setting register 113, comprises a first adder add1, integrator int, a first gain integrator g1, a state estimator obs, a second gain integrator g2 and a second adder add2.

In the calculation processor 131, the deviation (r−y) between the target value r set in the target setting register 118 and the counted value y counted by the counter 122 is first calculated by the first adder add1.

Then the accumulated value of the deviation ($\int(r-y)dt_0$) is calculated by means of the integrator int by discrete integration of the deviation calculated by the first adder add1 with respect to the time for calculation $t_0$ set in the timing setting register 112.

Subsequently, by the first gain integrator g1, a first control signal having a value "u1($=-F1*\int(r-y)dt_0$)" obtained by integrating the accumulated value of deviation calculated by the integrator int and the integral gain F1 set in the first gain setting register 115 is generated.

By the state estimator obs, the quantity of state x indicating the internal state of the paper transfer mechanism is estimated based on a control input u indicated by the control signal input to the transfer driving circuit 57 and the counted value y counted by the counter 122.

Then, by the second gain integrator g2, a second control signal having a value "u2($=-F_2*x$)" obtained by integrating the quantity of state x estimated by the state estimator obs and the state feedback gain F2 set in the second gain setting register 116.

Further, by the second adder add2, a control signal having a value "u(=u1+u2)" obtained by adding the first control signal and the second control signal as the control input u is generated.

The feed motor 62 rotates in a rotating direction and with an angular velocity in accordance with the value of the control input u of the control signal, which causes the first transfer roller 21 and the second transfer roller to rotate accordingly. When the control input u of the control signal is a positive value, the feed motor 62 increases the angular velocity of the first transfer roller 21 in the clockwise direction (the clockwise direction in FIG. 1) and the angular velocity of the second transfer roller 25 in the clockwise direction (the clockwise direction in FIG. 1) by the velocity corresponding to the absolute value of the control input u. In contrast, when the control input u of the control signal is a negative value, the feed motor 62 increases the angular velocity of the first transfer roller 21 in the counter-clockwise direction (the counter-clockwise direction in FIG. 1) and the angular velocity of the second transfer roller 25 in the counter-clockwise direction (the counter-clockwise direction in FIG. 1), i.e. decreases the angular velocities in the clockwise direction, by the velocity corresponding to the absolute value of the control input u.

Effects exhibited by the ink jet printer of the present Embodiment 3 will now be explained.

Since a DC motor is used as the feed motor 62, the resolution of the driving system is nearly limitless, i.e. there is no limitation to the stop position. Accordingly, it is possible to achieve paper transfer substantially corresponding to the moving amount detected by the motion sensor 70 in a highly accurate manner, thereby to control the transfer amount of the paper P in a highly accurate manner.

ii) Moreover, since the state estimator obs estimates the quantity of state x indicating the inner state of the paper transfer mechanism 20 based on the digital signal output by the motion sensor 70 in accordance with the transfer amount of the paper P, and the driving of the DC motor is controlled by means of state feedback control using the quantity of state x, it is possible to control the transfer amount of the paper P in a highly accurate and stable manner against disturbances such as changes in the environment (e.g. temperature, humidity) in which the ink jet printer is used and aged deterioration of the various mechanisms included in the ink jet printer.

(Embodiment 4)

While the observation object is an idle roller which moves accompanying the transfer of paper in the above embodiments, the observation object is paper itself in the present embodiment.

Figure 17:
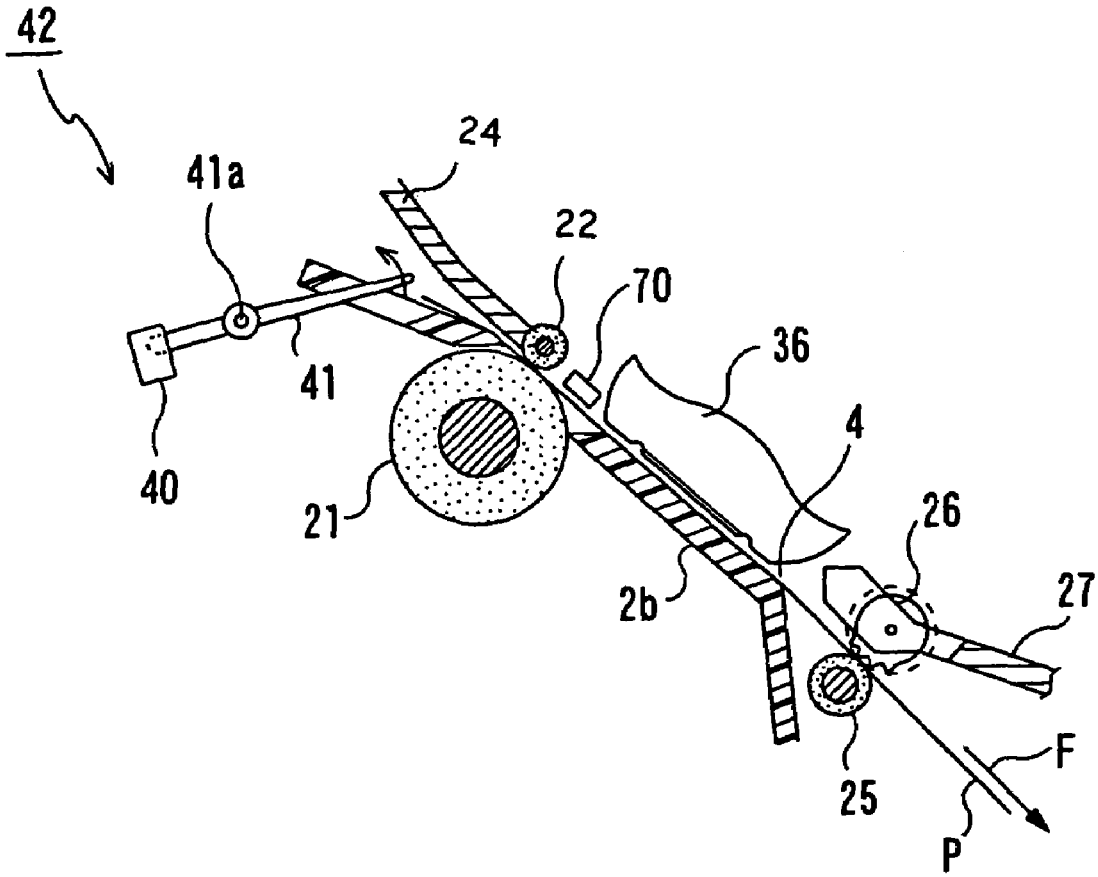
FIG. 17 is a sectional view illustrating the arrangement of the motion sensor in Embodiment 4.

In the present embodiment, as illustrated in FIG. 17, the motion sensor 70 is provided between the follower roller 22 which is in combination with the first transfer roller 21 and the printing head 36.

Figure 18:
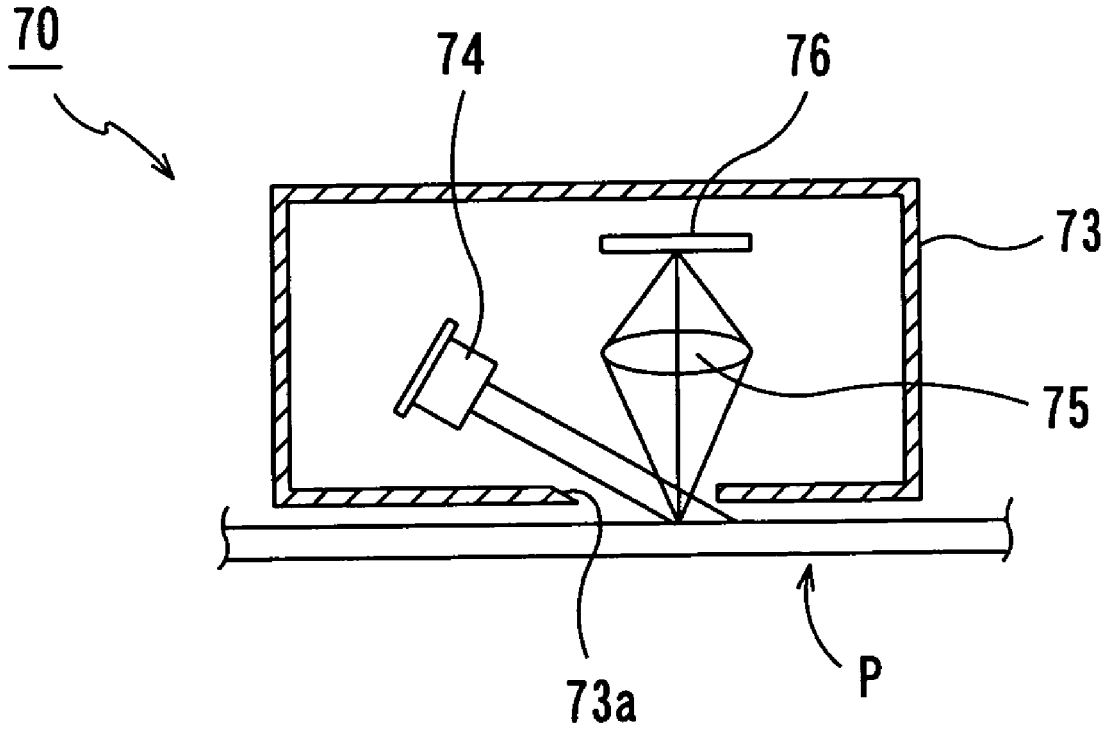
FIG. 18 is a sectional view illustrating the structure of the motion sensor in Embodiment 4.

As illustrated in FIG 18, the motion sensor 70 is provided with a semiconductor laser 74 for irradiating laser light towards the paper P, a lens 75 for focusing the reflected light of the laser light from the paper P, a two-dimensional semiconductor image sensor 76 for receiving the focused reflected light and a sensor housing 73 for containing the above members.

The laser light irradiated from the semiconductor laser 74 passes through an aperture portion 73*a* provided at a lower portion of the housing 73 and is reflected by the surface of the paper P. The reflected light again passing through the aperture portion 73*a* is focused by the lens 75 and made incident into the two-dimensional semiconductor image sensor 76. The two-dimensional semiconductor image sensor 76 is provided with a light-receiving portion in which, for example, pixels of approximately 5 μm are arranged in orders of 400 by 400, and performs photoelectric conversion of the reflected light for generating image signals. The image signals are sent to the A/D converter 66 through an amplifier 67 and are converted into digital signals.

As in the case of the reflected light from the idle roller described in Embodiment 1 through 3, spot-like interference patterns that are referred to as speckles (speckle patterns) are generated in the reflected, light from the paper P that are illustrative of the surface shape of the paper P at points the laser light is reflected. Such speckle patterns are also generated in the digital signals, which are image signals of the reflected light. Detailed explanation of paper transfer control using such digital signals is omitted here since it has already been provided with respect to Embodiments 1 through 3.

It should be noted that the present invention is not at all to be limited to the above embodiments but may be embodied in various forms without departing from the spirit of the present invention.

For example, the moving member, which is an idle roller in Embodiment 1 through Embodiment 3, may be a belt driven in accordance with the paper transfer, a disk rotating in accordance with the paper transfer and a spherical member rotating in accordance with the paper transfer.

Also, a so-called one-dimensional sensor provided with a plurality of picture elements at least along the moving direction of the paper P may be employed instead of the two-dimensional semiconductor image sensor 76 as in the embodiments.

What is claimed is:

1. An image forming device for transferring a medium to be printed on in order to perform image formation, the image forming device comprising:

transfer means for transferring the medium to be printed on;

drive means for driving the transfer means;

an observation object having a surface to be moved directly or indirectly by the transfer means;

surface condition signal generating means for irradiating the observation object with light having coherency, receiving the reflected light reflected by the surface of the observation object and generating signals with respect to the surface condition of the observation object in accordance with the received reflected light;

moving amount detecting means for calculating a moving amount of the observation object by chronologically comparing the surface condition signals generated by the surface condition signal generating means; and control means for controlling the drive means based on detection results of the moving amount of the observation object, which moves when the transfer means is driven by the drive means, obtained by the moving amount detecting means.

2. The image forming device as claimed in claim 1, wherein the medium to be printed on is paper on which an image is printed.

3. The image forming device as claimed in claim 1, wherein the observation object is the medium to be printed on.

4. The image forming device as claimed in claim 1, wherein the observation object is a moving member to move in accordance with the movement of the medium to be printed on.

5. The image forming device as claimed in claim 4, wherein the surface of the moving member is formed as a reflecting surface such that speckle patterns are generated in the reflected light.

6. The image forming device as claimed in claim 4, wherein the moving member is a roller to rotate in accordance with the movement of the medium to be printed on.

7. The image forming device as claimed in claim 6, wherein the light is irradiated onto an outer peripheral surface of the roller.

8. The image forming device as claimed in claim 6, wherein the roller comprises first outer diameter portions having a first outer diameter and a second outer diameter portion having a second outer diameter that is smaller than the first outer diameter, and wherein the light is irradiated onto the outer peripheral surface of the second outer diameter portion.

9. The image forming device as claimed in claim 6, wherein the roller contacts the medium to be printed on and is rotated in accordance with the transfer of the medium to be printed on.

10. The image forming device as claimed in claim 6, wherein the roller is arranged to be movable in a vertical direction with respect to the surface of the medium to be printed on and is pressed against the medium to be printed on at constant force.

11. The image forming device as claimed in claim 6, wherein the surface condition signal generating means comprises a frame portion for mounting a light source for irradiating the light and a photoreceptor for receiving the reflected light such that the positional relationship among the light source, the photoreceptor and the roller is maintained constant.

12. The image forming device as claimed in claim 4, wherein the position of a light source for irradiating the light, the position of the moving member reflecting the light and the position of the photoreceptor for receiving the reflected light are maintained constant with respect to one another in the surface condition signal generating means, irrespective of the thickness of the medium to be printed on.

13. The image forming device as claimed in claim 1, wherein receipt of the light is performed by employing a photoreceptor comprising a plurality of two-dimensionally arranged pixels.

14. The image forming device as claimed in claim 1, wherein the surface condition signal generating means is surrounded by a housing.

15. The image forming device as claimed in claim 1, wherein the light is irradiated in a downward facing manner in the surface condition signal generating means.

16. The image forming device as claimed in claim 1, further comprising image forming means for forming an image on the medium to be printed on, wherein the surface condition signal generating means is provided upstream of the image forming means in the transfer direction of the medium to be printed on.

17. The image forming device as claimed in claim 16, wherein an additional surface condition signal generating means is provided downstream of the image forming means in the transfer direction of the medium to be printed on.

18. The image forming device as claimed in claim 17, wherein the transfer amount of the medium to be printed on is calculated by using the surface condition signal that has been generated by the surface condition signal generating means on the downstream side after the medium to be printed on has passed a range in which the position of the medium to be printed on is detected by the surface condition signal generating means on the upstream side.

19. The image forming device as claimed in claim 1, wherein the moving amount detecting means calculates the moving amount by extracting characteristic points or characteristic patterns for detecting the moving amount based on the surface condition signal generated by the surface condition signal generating means, and comparing the positions of the characteristic points or the characteristic patterns.

20. The image forming device as claimed in claim 19, wherein the moving amount detecting means discards a detection result when the same fails in extraction of characteristic points.

21. The image forming device as claimed in claim 19, wherein the moving amount detecting means determines a transfer error when the same fails in extraction of characteristic points a predetermined number of consecutive times.

22. The image forming device as claimed in claim 19, wherein the characteristic points or the characteristic patterns extracted by the moving amount detecting means have a size such that the characteristic points or the characteristic patterns are within the measurement range of the surface condition signal generating means even when the observation object moves at the possible maximum speed and moving amount detection operations are performed at least two consecutive times.

23. The image forming device as claimed in claim 1, wherein the surface condition signal generating means includes a plurality of photoelectric transfer elements and has a measurement range in which when the observation object moves at a possible maximum speed, moving amount detection operations can be performed a plurality of times by the moving amount detecting means.

24. An image forming device for transferring paper to be printed on in order to perform image formation, the image forming device comprising:

transfer means for transferring the paper;

drive means for driving the transfer means;

surface condition signal generating means for irradiating the paper with light having coherency, receiving the reflected light reflected by the surface of the paper and generating signals with respect to the surface condition of the paper in accordance with the received reflected light;

moving amount detecting means for calculating a moving amount of the paper by chronologically comparing the surface condition signals generated by the surface condition signal generating means; and control means for controlling the drive means based on detection results of the moving amount of the paper, which moves when the transfer means is driven by the drive means, obtained by the moving amount detecting means.

25. An image forming device for transferring a medium to be printed on in order to perform image formation, the image forming device comprising:

a transfer mechanism for transferring the medium to be printed on;

a drive mechanism for driving the transfer mechanism;

an observation object having a surface to be moved directly or indirectly by the transfer mechanism;

a surface condition signal generator for irradiating the observation object with light having coherency, receiving the reflected light reflected by the surface of the observation object and generating signals with respect to the surface condition of the observation object in accordance with the received reflected light;

a moving amount detector for calculating a moving amount of the observation object by chronologically comparing the surface condition signals generated by the surface condition signal generator; and a controller for controlling the drive mechanism based on detection results of the moving amount of the observation object, which moves when the transfer mechanism is driven by the drive mechanism, obtained by the moving amount detector.

26. The image forming device as claimed in claim 25, wherein the medium to be printed on is paper on which an image is printed.

27. The image forming device as claimed in claim 25, wherein the observation object is the medium to be printed on.

28. The image forming device as claimed in claim 25, wherein the observation object is a moving member to move in accordance with the movement of the medium to be printed on.

29. The image forming device as claimed in claim 28, wherein the surface of the moving member is formed as a reflecting surface such that speckle patterns are generated in the reflected light.

30. The image forming device as claimed in claim 28, wherein the moving member is a roller to rotate in accordance with the movement of the medium to be printed on.

31. The image forming device as claimed in claim 30, wherein the light is irradiated onto an outer peripheral surface of the roller.

32. The image forming device as claimed in claim 30, wherein the roller comprises first outer diameter portions having a first outer diameter and a second outer diameter portion having a second outer diameter that is smaller than the first outer diameter, and wherein the light is irradiated onto the outer peripheral surface of the second outer diameter portion.

33. The image forming device as claimed in claim 30, wherein the roller contacts the medium to be printed on and is rotated in accordance with the transfer of the medium to be printed on.

34. The image forming device as claimed in claim 30, wherein the roller is arranged to be movable in a vertical direction with respect to the surface of the medium to be printed on and is pressed against the medium to be printed on at constant force.

35. The image forming device as claimed in claim 30, wherein the surface condition signal generator comprises a frame portion for mounting a light source for irradiating the light and a photoreceptor for receiving the reflected light such that the positional relationship among the light source, the photoreceptor and the roller is maintained constant.

36. The image forming device as claimed in claim 28, wherein the position of a light source for irradiating the light, the position of the moving member reflecting the light and the position of the photoreceptor for receiving the reflected light are maintained constant with respect to one another in the surface condition signal generator, irrespective of the thickness of the medium to be printed on.

37. The image forming device as claimed in claim 25, wherein receipt of the light is performed by employing a photoreceptor comprising a plurality of two-dimensionally arranged pixels.

38. The image forming device as claimed in claim 25, wherein the surface condition signal generator is surrounded by a housing.

39. The image forming device as claimed in claim 25, wherein the light is irradiated in a downward facing manner in the surface condition signal generator.

40. The image forming device as claimed in claim 25, further comprising an image forming mechanism for forming an image on the medium to be printed on, wherein the surface condition signal generator is provided upstream of the image forming mechanism in the transfer direction of the medium to be printed on.

41. The image forming device as claimed in claim 40, wherein an additional surface condition signal generator is provided downstream of the image forming mechanism in the transfer direction of the medium to be printed on.

42. The image forming device as claimed in claim 41, wherein the transfer amount of the medium to be printed on is calculated by using the surface condition signal that has been generated by the surface condition signal generator on the downstream side after the medium to be printed on has passed a range in which the position of the medium to be printed on is detected by the surface condition signal generator on the upstream side.

43. The image forming device as claimed in claim 25, wherein the moving amount detector calculates the moving amount by extracting characteristic points or characteristic patterns for detecting the moving amount based on the surface condition signal generated by the surface condition signal generator, and comparing the positions of the characteristic points or the characteristic patterns.

44. The image forming device as claimed in claim 43, wherein the moving amount detector discards a detection result when the same fails in extraction of characteristic points.

45. The image forming device as claimed in claim 43, wherein the moving amount detector determines a transfer error when the same fails in extraction of characteristic points a predetermined number of consecutive times.

46. The image forming device as claimed in claim 43, wherein the characteristic points or the characteristic patterns extracted by the moving amount detector have a size such that the characteristic points or the characteristic patterns are within the measurement range of the surface condition signal generator even when the observation object moves at the possible maximum speed and moving amount detection operations are performed at least two consecutive times.

47. The image forming device as claimed in claim 25, wherein the surface condition signal generator includes a plurality of photoelectric transfer elements and has a measurement range in which when the observation object moves at a possible maximum speed, moving amount detection operations can be performed a plurality of times by the moving amount detector.

48. An image forming device for transferring paper to be printed on in order to perform image formation, the image forming device comprising:

a transfer mechanism for transferring the paper;

a drive mechanism for driving the transfer mechanism;

a surface condition signal generator for irradiating the paper with light having coherency, receiving the reflected light reflected by the surface of the paper and generating signals with respect to the surface condition of the paper in accordance with the received reflected light;

a moving amount detector for calculating a moving amount of the paper by chronologically comparing the surface condition signals generated by the surface condition signal generator; and a controller for controlling the drive mechanism based on detection results of the moving amount of the paper, which moves when the transfer mechanism is driven by the drive mechanism, obtained by the moving amount detector.

* * * * *